US006655334B2

(12) United States Patent
Inagaki et al.

(10) Patent No.: US 6,655,334 B2
(45) Date of Patent: Dec. 2, 2003

(54) IGNITION APPARATUS FOR USE IN INTERNAL COMBUSTION ENGINE

(75) Inventors: Hiroshi Inagaki, Aichi (JP); Tomohiro Fuma, Aichi (JP); Takahiro Suzuki, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/132,161

(22) Filed: Apr. 26, 2002

(65) Prior Publication Data

US 2002/0157629 A1 Oct. 31, 2002

(30) Foreign Application Priority Data

Apr. 27, 2001 (JP) ..... 2001-131704

(51) Int. Cl.[7] ..... F02P 13/00; H01T 13/08
(52) U.S. Cl. ..... 123/169 OPA; 123/169 R
(58) Field of Search ..... 123/169 R, 169 P, 123/169 PA, 169 PH; 313/118

(56) References Cited

U.S. PATENT DOCUMENTS 2,850,000 A * 9/1958 Kauffmann et al. ..... 123/169 R
4,373,478 A * 2/1983 Rifat ..... 123/169 R
4,989,557 A * 2/1991 Penney ..... 123/169 R
5,091,672 A * 2/1992 Below ..... 123/169 R
5,535,726 A * 7/1996 Wilmot et al. ..... 123/169 PA

* cited by examiner

*Primary Examiner*—Tony M. Argenbright
(74) *Attorney, Agent, or Firm*—Sughrue Mion, PLLC

(57) ABSTRACT

A plug hole pipe 79 has thread grooves 81 formed on an outer circumferential surface thereof and causes a spark plug 11 to be pressed against a cylinder head 51 when the plug hole pipe is fixedly attached to the cylinder head 51 through screw engagement. The spark plug 11 is configured such that no thread grooves are formed on the outer circumferential surface of a front end portion 25 of a metallic shell 19, and can be vertically inserted into a plug disposition hole 51*a* formed in the cylinder head 51. By vertically inserting the spark plug 11 into the plug disposition hole 51*a* while the orientation of a ground electrode 21 is set beforehand in relation to the cylinder head 51, the ground electrode 21 can be oriented in a specific direction.

15 Claims, 9 Drawing Sheets

IGNITION APPARATUS FOR USE IN INTERNAL COMBUSTION ENGINE

BACKGROUND OF THE INVENTION

1. Field of the Invention

The present invention relates to an ignition apparatus for use in an internal combustion engine, the apparatus including one or more spark plugs attached to corresponding cylinders of the internal combustion engine and being adapted to induce spark discharge at the spark plugs for igniting an air-fuel mixture.

2. Description of the Related Art

Conventionally, in an internal combustion engine for use as an automobile engine or a like engine, a spark plug used for igniting an air-fuel mixture generally includes a center electrode inserted into a front end portion of an axial hole formed in an insulator, a metallic shell provided outside the insulator, and a ground electrode whose one end is joined to the metallic shell and whose opposite end faces the center electrode across a spark discharge gap.

Such spark plugs, together with ignition coils, among other components, constitute an ignition apparatus for use in an internal combustion engine. In the ignition apparatus for use in an internal combustion engine, high voltage for ignition is generated at an ignition coil and applied to a spark plug, whereby spark discharge is induced in a spark discharge gap to thereby ignite an air-fuel mixture within a combustion chamber.

A known spark plug is configured such that thread grooves are formed on the outer circumferential surface of the metallic shell for fixedly attaching the spark plug to a cylinder head through screw engagement.

In order to meet recent demands for high efficiency (improvement of fuel economy) and clean emission, some internal combustion engines employ a high air-fuel ratio (lean air-fuel ratio) for an air-fuel mixture. Such an internal combustion engine employing a lean air-fuel ratio involves a problem in that ignition of an air-fuel mixture is impaired when the amount of fuel present in the vicinity of the spark discharge gap is small. In order to cope with this problem, the internal combustion engine employing a lean air-fuel ratio utilizes a turbulent flow (swirl flow or tumble flow) of an air-fuel mixture within a combustion chamber for stabilizing ignition of an air-fuel mixture.

However, when turbulent flow of an air-fuel mixture is generated, the orientation of the ground electrode of a spark plug within a combustion chamber is known to influence ignition of the air-fuel mixture; i.e., when the ground electrode is oriented in a certain direction within the combustion chamber, ignition may be impaired. In connection with ignition of an air-fuel mixture through contact with spark discharge induced in the spark discharge gap of a spark plug, for example, when the ground electrode is located upstream of the spark discharge gap with respect to a turbulent flow of the air-fuel mixture, the ground electrode serves as a block and hinders contact between the air-fuel mixture and spark discharge. As a result, ignition of the air-fuel mixture may be impaired.

In the case of a spark plug which is attached to a cylinder head through screw engagement, the orientation of a ground electrode within a combustion chamber differs among cylinders and is thus uncertain; therefore, difficulty is encountered with such a spark plug in orienting a ground electrode in a specific direction. Also, in the case of a spark plug which is attached to a cylinder head through screw engagement, a slight dimensional error of thread grooves or individual differences cause variation of the orientation of a ground electrode within a combustion chamber at the final stage of attachment. Therefore, such a spark plug encounters difficulty in orienting a ground electrode in a specific direction.

Thus, according to a contemplated structure, a spark plug is loosely fitted into a cylinder head without forming thread grooves for fixation on a metallic shell of the spark plug and without forming internal thread grooves in the cylinder head for engaging the spark plug. Employment of a structure in which a spark plug is loosely fitted into a cylinder head for attachment can avoid variations in the orientation of a ground electrode within a combustion chamber among spark plugs and can facilitate orientation of a ground electrode in a specific direction within a combustion chamber. However, in contrast to a conventional structure in which a spark plug is attached to a cylinder head through screw engagement, in the devised structure, gastightness (seal) must be maintained between a spark plug and a cylinder head, and a spark plug must be held fixedly attached to the cylinder head in a stable condition when combustion pressure is applied to the spark plug from a combustion chamber.

SUMMARY OF THE INVENTION

It is therefore an object of the present invention to provide an ignition apparatus for use in an internal combustion engine, which facilitates orientation of a ground electrode within a combustion chamber at the final stage of attachment of a spark plug to a cylinder head, exhibits good gastightness between the spark plug and the cylinder head, and is capable of fixedly attaching the spark plug to the cylinder head in a stable condition by a simple structure.

In order to achieve the above object, the invention provides an ignition apparatus for use in an internal combustion engine, comprising a spark plug, which comprises a center electrode inserted into a front end portion of an axial hole formed in an insulator, a metallic shell provided outside the insulator, and a ground electrode joined to the metallic shell and forming a spark discharge gap between the ground electrode and the center electrode and which is disposed in a plug disposition hole formed in a cylinder head of the internal combustion engine, the ignition apparatus being adapted to induce spark discharge in the spark discharge gap of the spark plug for igniting an air-fuel mixture. The ignition apparatus is characterized in that the metallic shell of the spark plug comprises a flange portion having a plug seat formed on a front end face thereof and adapted to come in contact with the cylinder head directly or indirectly via another member, and a cylindrical front end portion extending axially frontward from the plug seat of the flange portion and having no thread grooves formed on an outer circumferential surface thereof, and in that a plug hole pipe, which is disposed rearward in relation to the plug seat of the metallic shell and is fixedly attached to the cylinder head, causes the plug seat of the metallic shell to be pressed against the cylinder head, whereby the spark plug is fixedly attached to the cylinder head.

A spark plug to be mounted on this ignition apparatus for use in an internal combustion engine has no thread grooves formed on the outer circumferential surface of the front end portion of the metallic shell; i.e., the ignition apparatus does not employ screw engagement for attaching the same to a cylinder head. The front end portion of the metallic shell has no thread grooves formed on the outer circumferential surface thereof, but is formed into a cylindrical shape, whereby the spark plug can be attached to the cylinder head while being loosely fitted into the cylinder head. Thus, when the spark plug is attached to the cylinder head, a position on the metallic shell where the ground electrode is joined can be readily set to a circumferentially specific position about the axis of the plug disposition hole (i.e., the ground electrode can be oriented in a specific direction within a combustion chamber), thereby preventing uncertain orientation of a ground electrode as is the case where a spark plug is screw-engaged with a cylinder head. For example, this spark plug allows orientation of the ground electrode in the following manner: the orientation of the ground electrode within a combustion chamber is set beforehand; and the spark plug is inserted into a cylinder head while the orientation of the ground electrode is maintained, and is then fixed, whereby at the final stage of attachment the ground electrode can be oriented in a specific direction within the combustion chamber.

The direction of a turbulent flow of an air-fuel mixture in a combustion chamber depends on the structure of an inlet pipe and that of a combustion chamber and is thus substantially constant with respect to a cylinder head. Therefore, when the spark plug is to be attached to the cylinder head, by setting beforehand the orientation of the ground electrode within the combustion chamber in view of the direction of a turbulent flow of an air-fuel mixture, the ground electrode can be oriented within the combustion chamber in a specific direction in relation to the direction of a turbulent flow of an air-fuel mixture. In contrast to a conventional practice, the plug disposition hole does not require thread grooves, and therefore the diameter (inside diameter) of the plug disposition hole can be reduced, thereby facilitating disposition of large-area inlet and exhaust valves on the cylinder head and facilitating design for such disposition.

The ignition apparatus for use in an internal combustion engine of the present invention is characterized in that, when a spark plug including a metallic shell whose front end portion has no thread grooves formed on an outer circumferential surface thereof and is formed into a cylindrical shape as described above is to be fixedly attached to a cylinder head, a plug hole pipe, which is disposed rearward in relation to the plug seat of the metallic shell and fixedly attached to the cylinder head, is used for the fixation, and is further characterized in that the plug hole pipe causes the plug seat to be pressed against the cylinder head. Notably, the term "rearward" used in relation to a spark plug refers to the side toward an axial end of the spark plug opposite the front end of the spark plug.

Incidentally, an intake-valve-exhaust-valve drive mechanism including cam shafts and adapted to drive intake and exhaust valves is provided on an upper portion of a cylinder head of an internal combustion engine. In order to smoothly operate the intake-valve-exhaust-valve drive mechanism, lubricating oil is circulated within the upper portion of the cylinder head. Since high voltage for ignition generated by an ignition coil is applied to a spark plug for induction of spark discharge, adhesion of lubricating oil raises a problem in that spark discharge cannot be induced normally, because of electrical leakage or a like cause. In order to cope with this problem, the internal combustion engine employs a plug hole pipe whose inside diameter is determined so as to allow insertion of a spark plug thereinto and which is provided on the upper portion of the cylinder head where the intake-valve-exhaust-valve drive mechanism is disposed, thereby providing a spark plug disposition space and isolating the spark plug from lubricating oil. The plug hole pipe is fixedly attached to the cylinder head such that the axis thereof is aligned with that of the spark plug.

In the present invention, the plug hole pipe is used not only for isolating a spark plug from lubricating oil by determining an inside diameter thereof such that the same can enclose the spark plug, but also as a fixation member for fixedly attaching the spark plug to a cylinder head.

By using a plug hole pipe to be attached to a cylinder head as a fixation member for fixedly attaching, to the cylinder head, a spark plug whose metallic shell has no thread grooves formed thereon, the number of components can be reduced as compared with the case where a fixation member for fixing a spark plug is newly added. Since a special fixation member is not employed, manufacturing cost can be reduced, and a spark plug whose metallic shell has no thread grooves formed thereon can be fixedly attached to a cylinder head by use of a simple structure.

In contrast to a conventional structure in which a spark plug is attached to a cylinder head through screw engagement, when a spark plug whose metallic shell has no thread grooves formed thereon is fixedly attached to a cylinder head, gastightness (seal) must be maintained between the spark plug and the cylinder head, and the spark plug must be held fixedly attached to the cylinder head in a stable condition even when combustion pressure is applied to the spark plug from a combustion chamber, or the internal combustion engine itself undergoes strong vibration.

According to the present invention, in order to maintain gastightness between a spark plug and a cylinder head, a plug hole pipe is fixedly attached to the cylinder head such that the plug seat of a metallic shell is pressed against the cylinder head, and the plug hole pipe causes the spark plug to be fixedly attached to the cylinder head. As a result, the plug seat of the flange portion of the metallic shell is uniformly pressed against the cylinder head along the circumferential direction, whereby the plug seat and the cylinder head can maintain stable contact with each other. Further, since the plug hole is fixedly attached to the cylinder head such that the plug seat of the metallic shell is pressed against the cylinder head, even when combustion pressure is applied to the spark plug from a combustion chamber, the spark plug can be held fixedly attached to the cylinder head in a stable condition.

Preferably, in order to fixedly attach the spark plug to the cylinder head in a stable condition by use of the plug hole pipe, the plug hole pipe is attached to the cylinder head such that the plug seat of the metallic shell is pressed against the cylinder head by a pressing force greater than combustion pressure generated by combustion of an air-fuel mixture; specifically, by a pressing force of not less than 10 MPa.

Thus, according to the ignition apparatus for use in an internal combustion engine of the present invention, at the final stage of attachment of the spark plug, the ground electrode can be oriented within the combustion chamber in a specific direction in relation to the direction of a turbulent flow of an air-fuel mixture. Also, the plug hole pipe is used not only for isolating the spark plug from lubricating oil, but also as a fixation member for fixedly attaching the spark plug to the cylinder head, whereby the spark plug, whose metallic shell has no thread grooves formed thereon, can be fixedly attached to the cylinder head in a stable condition and in a manner such that contact between the spark plug and the cylinder head is favorably maintained even when vibration of the internal combustion engine is propagated to the spark plug.

Preferably, when the plug hole pipe is to be fixedly attached to the cylinder head such that the plug seat of the metallic shell is pressed against the cylinder head, the plug hole pipe to be disposed rearward in relation to the plug seat of the metallic shell abuts and presses a portion of the metallic shell to thereby fixedly attach the spark plug to the cylinder head.

By fixedly attaching the plug hole pipe to the cylinder head such that the plug hole pipe abuts and presses a portion of the metallic shell as described above, the plug seat of the metallic shell can be reliably pressed against the cylinder head. Thus, the spark plug, whose metallic shell has no thread grooves formed thereon, can be fixedly attached to the cylinder head in a stable condition and in a manner such that contact between the spark plug and the cylinder head is favorably maintained even when vibration of the internal combustion engine is propagated to the spark plug.

Preferably, when the plug hole pipe is caused to abut a portion of the metallic shell, the plug hole pipe accommodates a portion of the spark plug which extends rearward from the rear end face of the flange portion of the metallic shell, the rear end face being an end face located opposite the plug seat, and abuts and presses the rear end face of the flange portion of the metallic shell to thereby fixedly attach the spark plug to the cylinder head. Thus, the plug seat of the metallic shell can be reliably pressed against the cylinder head by use of the plug hole pipe.

Preferably, in the case of a spark plug whose metallic shell comprises a crimped portion, which is formed by crimping a circumferential edge of a rear end portion thereof toward an outer circumferential portion of an insulator, the plug hole pipe accommodates a portion of the spark plug which extends rearward from the crimped portion of the metallic shell, and abuts and presses the crimped portion to thereby fixedly attach the spark plug to the cylinder head. Thus, the plug seat of the metallic shell can be reliably pressed against the cylinder head by use of the plug hole pipe. Additionally, as compared with the above-described structure in which the plug hole pipe is caused to abut the end face of the flange portion, the outside diameter of the plug hole pipe can be reduced, thereby reducing a space which the plug hole pipe occupies within the cylinder head, and thus increasing a space for disposing other devices, such as an intake-valve-exhaust-valve mechanism.

Preferably, in the above-described ignition apparatus for use in an internal combustion engine, in which the spark plug is fixedly attached to the cylinder head by use of the plug hole pipe, the plug hole pipe is fixedly attached to the cylinder head through press fitting.

In conventional internal combustion engines, press fitting is the most widely used method for fixedly attaching a plug hole pipe to a cylinder head, and the plug hole pipe can be firmly attached to the cylinder head through press fitting. Thus, the spark plug can be pressed against the cylinder head by a pressing force greater than combustion pressure, and the spark plug, whose metallic shell has no thread grooves formed thereon, can be fixedly attached to the cylinder head in a reliable condition.

Once a plug hole pipe is fixedly attached to a cylinder head through press fitting, removal of the attached plug hole pipe is difficult. Therefore, this press-fitting method is not suited for an internal combustion engine which requires periodic replacement of spark plugs.

Thus, preferably, in the above-described ignition apparatus for use in an internal combustion engine, in which the spark plug is fixedly attached to the cylinder head by use of the plug hole pipe, the plug hole pipe comprises a flange portion projecting outward from an outer circumferential surface thereof, and the flange portion is fixedly attached the cylinder head, whereby the plug hole pipe is fixedly attached to the cylinder head.

Utilizing the flange portion for fixedly attaching the plug hole pipe to the cylinder head eliminates the need to press-fit the plug hole pipe into the cylinder head. By fixedly attaching the flange portion to the cylinder by a method that allows removal of the attached flange portion, the fixedly attached plug hole pipe can be removed from the cylinder head.

The flange portion may be fixedly attached to the cylinder head, for example, by use of bolts or the like or by a method in which an engagement portion is provided on the cylinder head and used such that, after a spark plug is held between the plug hole pipe and the cylinder head, the plug hole pipe is turned about the center axis thereof to thereby engage the flange portion with the engagement portion.

Preferably, in the above-described ignition apparatus for use in an internal combustion engine, in which the spark plug is fixedly attached to the cylinder head by use of the plug hole pipe, the plug hole pipe has thread grooves formed on an outer circumferential surface thereof, and the thread grooves are engaged with thread grooves formed on the cylinder head, whereby the plug hole pipe is fixedly attached to the cylinder head.

This fixation method allows removal of the fixedly attached plug hole pipe from the cylinder head and enables fixation of the plug hole pipe onto the cylinder head without use of additional members such as bolts. Also, through control of torque applied for tightening the plug hole pipe into the cylinder head, a force (load) to be applied to the spark plug by the plug hole pipe can be rendered substantially constant, whereby the plug hole pipe can cause the plug seat of the metallic shell to be pressed against the cylinder head stably and without variations among spark plugs.

Thus, according to the ignition apparatus for use in an internal combustion engine of the present preferred aspect of the invention, the spark plug can be replaced and can be fixedly attached to the cylinder head by use of a small number of components, thereby reducing the cost of manufacturing the internal combustion engine.

Preferably, in the above-described ignition apparatus for use in an internal combustion engine, in which the spark plug is fixedly attached to the cylinder head by use of the plug hole pipe, a cylinder head cover is provided on the cylinder head, and the plug hole pipe is held between the cylinder head cover and the cylinder head to thereby be fixedly attached to the cylinder head.

This fixation method utilizes the cylinder head cover to be provided on the cylinder head, for fixing the plug hole pipe within the cylinder head. Specifically, a force associated with fixation of the cylinder head cover onto the cylinder head with the plug hole pipe being held therebetween is used for fixedly attaching the plug hole pipe to the cylinder head and transmitted to the plug hole pipe, whereby the plug seat of the metallic shell can be reliably pressed against the cylinder head by use of the plug hole pipe.

As discussed above, in the case of the spark plug whose metallic shell has no thread grooves formed thereon, when the spark plug is attached to the cylinder head, a position on the metallic shell where the ground electrode is joined can be readily set to a circumferentially specific position about the axis of the plug disposition hole (i.e., the ground electrode can be oriented in a specific direction within a combustion chamber). However, after the spark plug is inserted into the plug disposition hole, the spark plug may turn with a resultant change in the orientation of the ground electrode within the combustion chamber.

Thus, preferably, in the ignition apparatus for use in an internal combustion engine described above, the spark plug is configured such that the metallic shell comprises an anti-rotation portion which is engaged with the cylinder head at one or more positions when the spark plug is turned about the axis of the plug disposition hole in the course of attachment to the cylinder head; the cylinder head comprises an anti-rotation reception portion corresponding to the anti-rotation portion; and when the spark plug is fixedly attached to the cylinder head, the position of the joint between the metallic shell and the ground electrode is aligned with a predetermined circumferential position about the axis of the plug disposition hole.

The anti-rotation portion formed on the metallic shell and the anti-rotation reception portion formed on the cylinder head are fitted to or engaged with each other to thereby disable the spark plug turning about its axis and to thereby specify the orientation of the ground electrode within the combustion chamber when the spark plug is attached to the cylinder head. The anti-rotation portion may assume the form of, for example, a protrusion extending axially on the outer surface of a flange portion or front end portion of the metallic shell or a groove formed axially on the outer surface of the flange portion or front end portion of the metallic shell. Alternatively, the flange portion or front end portion of the metallic shell may include a special-section portion whose section taken along a plane perpendicular to the axial direction of the spark plug assumes a shape other than circle (polygon (such as hexagon), oval, etc.) and which serves as an anti-rotation portion.

In this case, the anti-rotation reception portion capable of being fitted to or engaged with the above-described anti-rotation portion is provided on the cylinder head such that the ground electrode is oriented in a direction of good ignition within the combustion chamber. Thus, merely by fitting (engaging) the anti-rotation portion of the metallic shell to (with) the anti-rotation reception portion formed on the cylinder head, the ground electrode can be reliably and readily oriented in a predetermined direction of good ignition within the combustion chamber.

Thus, according to the ignition apparatus for use in an internal combustion engine of the present preferred aspect of the invention, after the ground electrode is oriented in a certain direction within the combustion chamber in the course of attachment of the spark plug to the cylinder head, a change in the orientation of the ground electrode can be prevented, and the ground electrode can be readily and reliably oriented in a specific direction within the combustion chamber, whereby good ignition can be attained.

Incidentally, a plug hole pipe is originally intended to isolate a spark plug from lubricating oil. As a result of adding to the plug hole pipe a function for fixedly attaching a spark plug to a cylinder head, the structure of the plug hole pipe becomes complicated to a certain degree as compared with a conventional plug hole pipe. Therefore, a dimensional error or a like factor may cause formation of clearance between the plug hole pipe and the cylinder head, potentially resulting in penetration of lubricating oil.

Thus, preferably an oil seal member is provided between the plug hole pipe and the cylinder head. The oil seal member prevents adhesion of lubricating oil to the spark plug, thereby preventing occurrence of an anomaly, such as the spark plug's failing to induce normal spark discharge, which would otherwise result from adhering lubricating oil. The oil seal member is formed of, for example, an elastically deformable material (rubber, etc.). The sectional shape of the oil seal member is deformed according to clearance formed between the plug hole pipe and the cylinder head to thereby fill the clearance, thereby favorably preventing penetration of lubricating oil.

Preferably, in the ignition apparatus for use in an internal combustion engine described above, the plug seat of the metallic shell of the spark plug is in contact with the cylinder head via a gasket.

By employing a gasket, when the spark plug is fixedly attached to the cylinder head such that the plug hole causes the plug seat of the metallic shell to be pressed against the cylinder head, gastightness between the spark plug and the cylinder head can be maintained more reliably. Also, since a heat release path via the gasket is established, the spark plug's performance (particularly heat resistance) can be retained.

BRIEF DESCRIPTION OF THE DRAWINGS

FIG. 5(*b*) is an exterior view of the second spark plug as viewed from the front end side;

FIG. 6(*b*) is an exterior view of the third spark plug as viewed from the front end side;

FIG. 7(*b*) is an exterior view of the fourth spark plug as viewed from the front end side;

Figure 1:
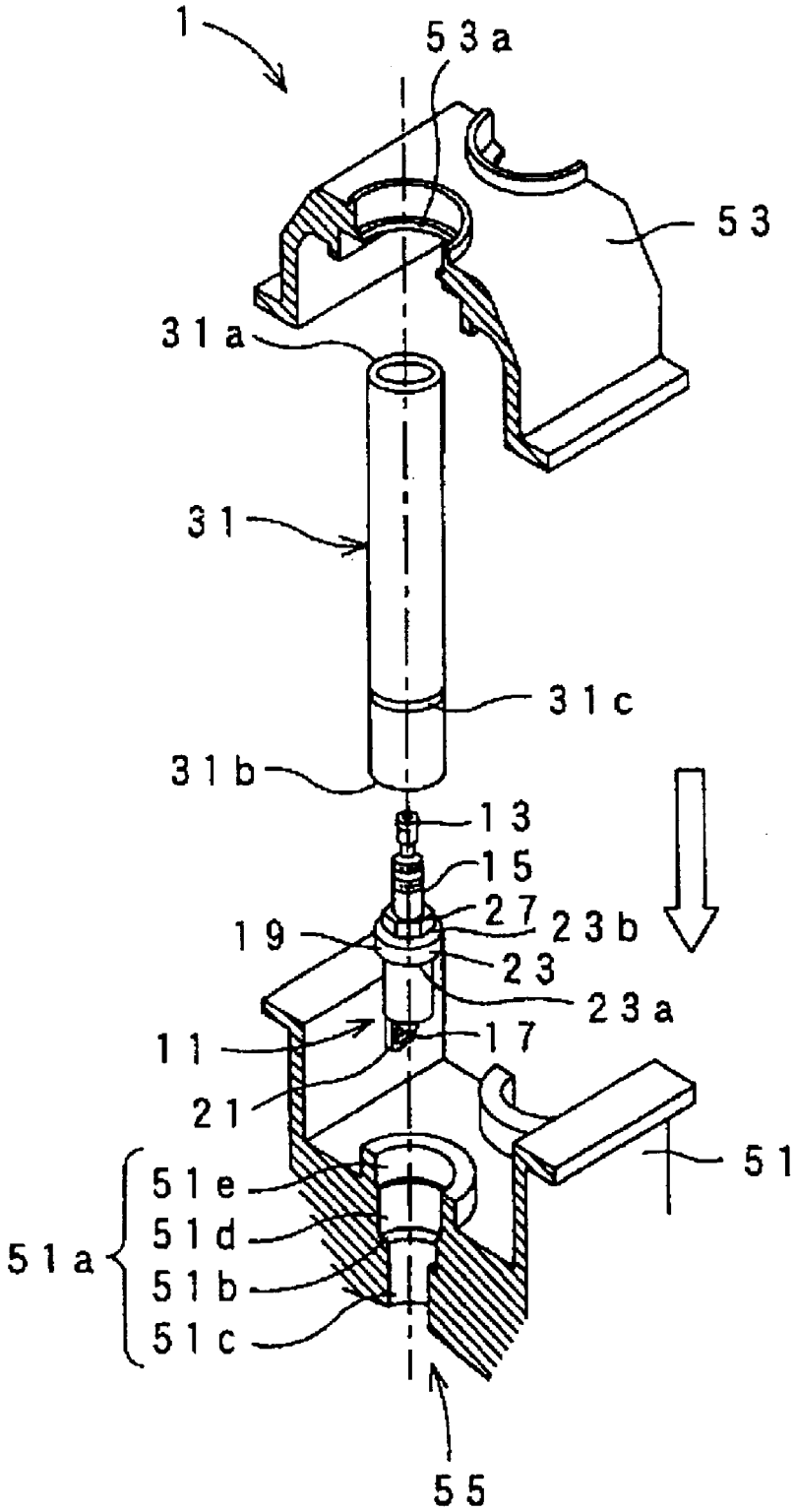
FIG. 1 is an explanatory view showing the state of attachment, to a cylinder head, of a spark plug and a plug hole pipe included in an ignition apparatus for use in an internal combustion engine of a first embodiment.

Reference numerals are used to identify items shown in the drawings as follows:

1: ignition apparatus for use in internal combustion engine
11: spark plug
11*a*: second spark plug
11*b*: third spark plug
11*c*: fourth spark plug
13: terminal electrode
15: insulator
17: center electrode
19: metallic shell
21: ground electrode
23: flange portion

23*a:* plug seat
23*b:* rear end face
25: front end portion
27: crimped portion
31: plug hole pipe
51: cylinder head
51*a:* plug disposition hole
53: cylinder head cover
63: oil seal
65: protrusion
67: groove
69: flat portion
71: gasket
73: second plug hole pipe
75: flange portion
79: third plug hole pipe
81: thread grooves
91: fourth plug hole pipe
93: fifth plug hole pipe
g: spark discharge gap Detailed Description of the Preferred Embodiments FIG. 1 is an explanatory view showing the state of attachment, to a cylinder head 51, of a spark plug 11 and a plug hole pipe 31 included in an ignition apparatus for use in an internal combustion engine 1 of a first embodiment of the present invention.

As shown in FIG. 1, the spark plug 11 is disposed in a plug disposition hole 51*a* formed in the cylinder head 51 of an internal combustion engine, and the plug hole pipe 31 is disposed while extending between the cylinder head 51 and a cylinder head cover 53 of the internal combustion engine.

Notably, in a space defined by the cylinder head 51 and the cylinder head cover 53, an intake-valve-exhaust-valve drive mechanism (not shown in FIG. 1) including cam shafts and adapted to drive intake and exhaust valves is provided, and lubricating oil for smoothly operating the intake-valve-exhaust-valve drive mechanism is circulated.

The ignition apparatus for use in an internal combustion engine 1 includes an ignition coil having a primary winding and a secondary winding and an igniter having a power switching element, which are not shown in FIG. 1. The igniter controls supply and cutoff of power to the primary winding to thereby generate high voltage for ignition at the secondary winding of the ignition coil. When the high voltage for ignition is applied to the spark plug 11, spark discharge is induced in a spark discharge gap g (see FIG. 2) formed between a center electrode 17 and a ground electrode 21 of the spark plug 11. That is, the ignition apparatus for use in an internal combustion engine 1 is adapted to induce spark discharge in the spark discharge gap g of the spark plug 11 to thereby ignite an air-fuel mixture by the spark discharge.

The cylinder head 51 includes the plug disposition hole 51*a* in which the spark plug 11 is disposed. The plug disposition hole 51*a* includes a step face 51*b,* which comes in contact with a plug seat 23*a* (see FIG. 2) of a metallic shell 19 of the spark plug 11 directly or indirectly via another member; a first wall surface 51*c,* which is located on the side toward a combustion chamber 55 with respect to the step face 51*b*; and a second wall surface 51*d* and a third wall surface 51*e,* which are located on the side toward the cylinder head cover 53 with respect to the step face 51*b*.

As shown in FIG. 1, the plug hole pipe 31 is a cylindrical member formed of a metallic material, such as stainless steel or aluminum, opens at a rear end 31*a* and at a front end 31*b,* and can accommodate a portion of the spark plug 11 which extends rearward (upward in FIG. 1) from the plug seat 23*a* of a flange portion 23 of the metallic shell 19. After the spark plug 11 is disposed in the plug disposition hole 51*a* formed in the cylinder head 51, the plug hole pipe 31 is press-fitted into the plug disposition hole 51*a* while a rear end portion of the spark plug 11 is inserted therein through the front end 31*b*, to thereby be fixedly attached to the cylinder head 51.

Figure 2:
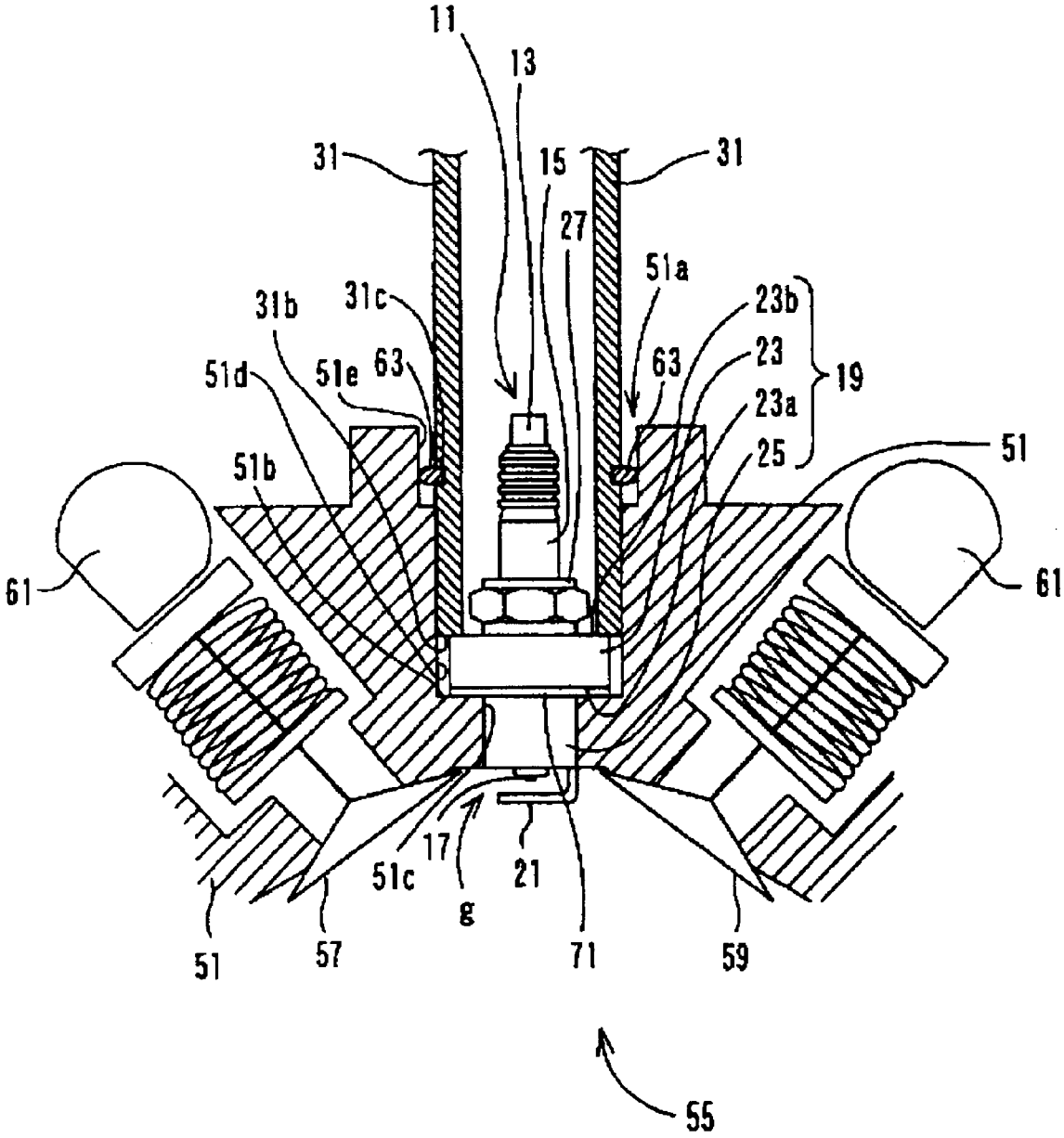
FIG. 2 is a sectional view of a cylinder head in which the spark plug and the plug hole pipe are disposed.

FIG. 2 is a sectional view of the cylinder head 51 in which the spark plug 11 and the plug hole pipe 31 are disposed. As shown in FIG. 2, an intake valve 57 and an exhaust valve 59 are provided in the cylinder head 51; and in an upper portion of the cylinder head 51, an intake-valve-exhaust-valve drive mechanism including cam shafts 61 and adapted to drive the intake valve 57 and the exhaust valve 59 is provided, and lubricating oil for smoothly operating the intake-valve-exhaust-valve drive mechanism is present.

As shown in FIG. 2, the spark plug 11 includes the center electrode 17 inserted into a front end portion (a lower end portion in FIG. 2) of an axial hole formed in an insulator 15; the metallic shell 19 provided outside the insulator 15; the ground electrode 21, whose one end is joined to the metallic shell 19 and whose opposite end forms the spark discharge gap g between the same and the center electrode 17; and a terminal electrode 13 inserted into a rear end portion (an upper end portion in FIG. 2) of the axial hole formed in the insulator 15 and electrically connected to the center electrode 17. The metallic shell 19 includes a crimped portion 27, which is formed by crimping the circumferential edge of a rear end portion thereof toward an outer circumferential portion of the insulator 15. The crimped portion 27 prevents the insulator 15 from coming-off, which is engaged with an engagement portion (not shown) formed on the inside of the metallic shell 19, whereby the insulator 15 is held by the metallic shell 19.

The metallic shell 19 includes the flange portion 23 having the plug seat 23*a* formed on the front end face thereof and adapted to come in contact with the step face 51*b* of the plug disposition hole 51*a* formed in the cylinder head 51 directly or indirectly via another member (via a gasket 71 in the present embodiment), and a cylindrical front end portion 25 extending axially frontward from the plug seat 23*a* of the flange portion 23 and having no thread grooves formed on the outer circumferential surface thereof. A rear end face 23*b* is formed on an end face of the flange portion 23 located opposite the plug seat 23*a*.

The front end portion 25 of the metallic shell 19 has an axial length equal to the length as measured between the step face 51*b* of the plug disposition hole 51*a* and the combustion chamber 55. Thus, when the spark plug 11 is disposed in the plug disposition hole 51*a*, the spark discharge gap g is located in the combustion chamber 55.

As shown in FIG. 2, the spark plug 11 fixedly rests in the plug disposition hole 51*a* such that the plug seat 23*a* of the flange portion 23 is in contact with the step face 51*b* of the plug disposition hole 51*a* via the gasket 71, and the rear end face 23*b* of the flange portion 23 abuts the front end 31*b* of the plug hole pipe 31. Further, the plug hole pipe 31 is attached to the cylinder head 51 such that the front end 31*b* of the plug hole pipe 31 presses the rear end face 23*b* of the flange portion 23 of the metallic shell 19, whereby the plug seat 23*a* of the metallic shell 19 of the spark plug 11 is pressed against the cylinder head (specifically, the step face 51*b* of the plug disposition hole 51*a*), and in this state the spark plug 11 is fixedly attached to the cylinder head 51.

The plug hole pipe 31 is formed such that the inside diameter thereof is smaller than the outside diameter of the flange portion 23 of the spark plug 11, and thus the front end 31*b* abuts the rear end face 23*b* of the flange portion 23 of the spark plug 11. Thus, the plug hole pipe 31 is smaller in outside diameter than a conventional plug hole pipe.

In the plug disposition hole 51*a*, the first wall surface 51*c* faces the front end portion 25 of the metallic shell 19, and the second wall surface 51*d* faces the outer circumferential surface of the flange portion 23 of the spark plug 11 and the outer circumferential surface of the plug hole pipe 31. Further, the plug disposition hole 51*a* includes the third wall surface 51*e*, which faces the outer circumferential surface of the plug hole pipe 31 via an oil seal 63. Notably, clearance is provided between the first wall surface 51*c* of the plug disposition hole 51*a* and the front end portion 25 of the metallic shell 19 so that the spark plug 11 can be inserted into the cylinder head 51 in a loose fit condition. Preferably, the clearance satisfies the relation as represented by $0\ \text{mm} < D - d \leqq 1.0\ \text{mm}$, where D is the inside diameter of a portion of the plug disposition hole 51*a* corresponding to the first surface 51*c*, and d is the outside diameter of the front end portion 25 of the metallic shell 19.

When the plug hole pipe 31 is press-fitted into the plug disposition hole 51*a*, the plug hole pipe 31 is tightly held by the second wall surface 51*d* to thereby be fixedly attached to the cylinder head 51. The plug hole pipe 31 tightly held by the second wall surface 51*d* presses the plug seat 23*a* of the spark plug 11 against the cylinder head 51 by a force (not less than 10 MPa) greater than the combustion pressure generated by combustion of an air-fuel mixture, thereby fixedly attaching the spark plug 11 to the cylinder head 51. Thus, even when combustion pressure is generated by combustion of an air-fuel mixture, the spark plug 11, which includes the metallic shell 19 having no thread grooves formed thereon, is held fixedly attached to the cylinder head 51 in a stable condition, and good gastightness is maintained between the spark plug 11 and the cylinder head 51.

In the course of press-fitting the plug hole pipe 31 into the plug disposition hole 51*a*, the oil seal 63 is disposed between the plug hole pipe 31 and the third wall surface 51*e* of the plug disposition hole 51*a*. The oil seal 63 is an annular member formed of a heat resistant, elastically deformable material. While the oil seal 63 is held between the plug hole pipe 31 and the third wall surface 51*e*, the sectional shape of the same is deformed to thereby fill clearance formed between the plug hole pipe 31 and the cylinder head 51 (specifically, the third wall surface 51*e*). Thus, penetration of lubricating oil through the clearance between the plug hole pipe 31 and the cylinder head 51 can be prevented. In FIG. 1, the oil seal 63 is not illustrated. The oil seal 63 is disposed while being fitted into a groove 31*c* formed circumferentially on the outer circumferential surface of the plug hole pipe 31. In the course of press-fitting the plug hole pipe 31 into the plug disposition hole 51*a*, the oil seal 63 is elastically deformed while being held between the plug hole pipe 31 and the third wall surface 51*e* of the plug disposition hole 51*a*.

After the plug hole pipe 31 is fixedly attached to the cylinder head 51, the cylinder head cover 53 is fixedly attached to an upper portion of the cylinder head 51, whereby the rear end 31*a* of the plug hole pipe 31 abuts an opening portion 53*a* of the cylinder head cover 53 (see FIG. 1). At this time, an oil seal (not shown) for preventing penetration of lubricating oil is disposed between the rear end 31*a* of the plug hole pipe 31 and the opening portion 53*a* of the cylinder head cover 53. Thus, the plug hole pipe 31 can isolate the spark plug 11 from lubricating oil, thereby preventing adhesion of lubricating oil to the spark plug 11.

The spark plug 11 of the present embodiment is configured such that thread grooves are not formed on the outer circumferential surface of the front end portion 25 of the metallic shell 19, and thus does not employ screw engagement as a method for fixedly attaching the same to the cylinder head 51. Therefore, a position on the metallic shell 19 where the ground electrode 21 is joined can be readily set to a circumferentially specific position about the axis of the plug disposition hole 51*a* (i.e., the ground electrode 21 can be oriented in a specific direction within the combustion chamber 55). Since the front end portion 25 of the metallic shell 19 has no thread grooves formed on the outer circumferential surface thereof and is formed into a cylindrical shape, the spark plug 11 can be inserted, in a loose fit condition, into the plug disposition hole 51*a* formed in the cylinder head 51. Therefore, as compared with a case where a spark plug is attached to a cylinder head through screw engagement, the spark plug 11 can be easily attached.

Thus, the spark plug 11 allows easy orientation of the ground electrode 21 in the following manner: the orientation of the ground electrode 21 within the combustion chamber 55 is set beforehand; and the spark plug 11 is inserted into the plug disposition hole 51*a* while the orientation of the ground electrode 21 is maintained, whereby at the final stage of attachment the ground electrode 21 can be oriented in a specific direction within the combustion chamber 55. Subsequently, the plug hole pipe 31 is press-fitted into the plug disposition hole 51*a* and thereby causes the plug seat 23*a* of the metallic shell 19 to be pressed against the cylinder head 51, whereby the spark plug 11 can be fixedly attached to the cylinder head 51.

In the ignition apparatus for use in an internal combustion engine 1 of the present embodiment, the spark plug 11 is fixedly attached to the cylinder head 51 such that the ground electrode 21 is oriented, in relation to the cylinder head 51, within the combustion chamber 55 in view of the direction of a turbulent flow of an air-fuel mixture within the combustion chamber so as to attain good ignition of an air-fuel mixture.

As described above, in the ignition apparatus for use in an internal combustion engine 1 of the first embodiment, the plug hole pipe 31 causes the plug seat 23*a* of the metallic shell 19 to be pressed against the cylinder head 51, whereby the spark plug 11 is fixedly attached to the cylinder head 51. Since screw engagement is not employed as a method for attachment of the spark plug 11, in the course of fixedly attaching the spark plug 11 to the cylinder 51, a position on the metallic shell 19 where the ground electrode 21 is joined can be readily set to a circumferentially specific position about the axis of the plug disposition hole 51*a* (i.e., the ground electrode 21 can be oriented in a specific direction within the combustion chamber 55).

In the ignition apparatus for use in an internal combustion engine 1 of the first embodiment, the plug hole pipe 31 is used not only for isolating the spark plug 11 from lubricating oil, but also as a fixation member for fixedly attaching the spark plug 11 to the cylinder head 51. Therefore, when the spark plug 11—whose metallic shell 19 has no thread grooves formed thereon in order to allow orientation of the ground electrode 21 in a specific direction within the combustion chamber 55—is to be fixedly attached to the cylinder head 51, there is no need to newly add a fixation member, thereby preventing increase in the number of components.

According to the ignition apparatus for use in an internal combustion engine 1 of the first embodiment, the oil seal 63 seals clearance between the plug hole pipe 31 and the plug disposition hole 51*a* formed in the cylinder head 51, thereby preventing penetration of lubricating oil. Thus, adhesion of lubricating oil to the spark plug 11 can be prevented, thereby preventing the spark plug's failing to induce normal spark discharge, which would otherwise result from adhering lubricating oil.

Figure 5A:
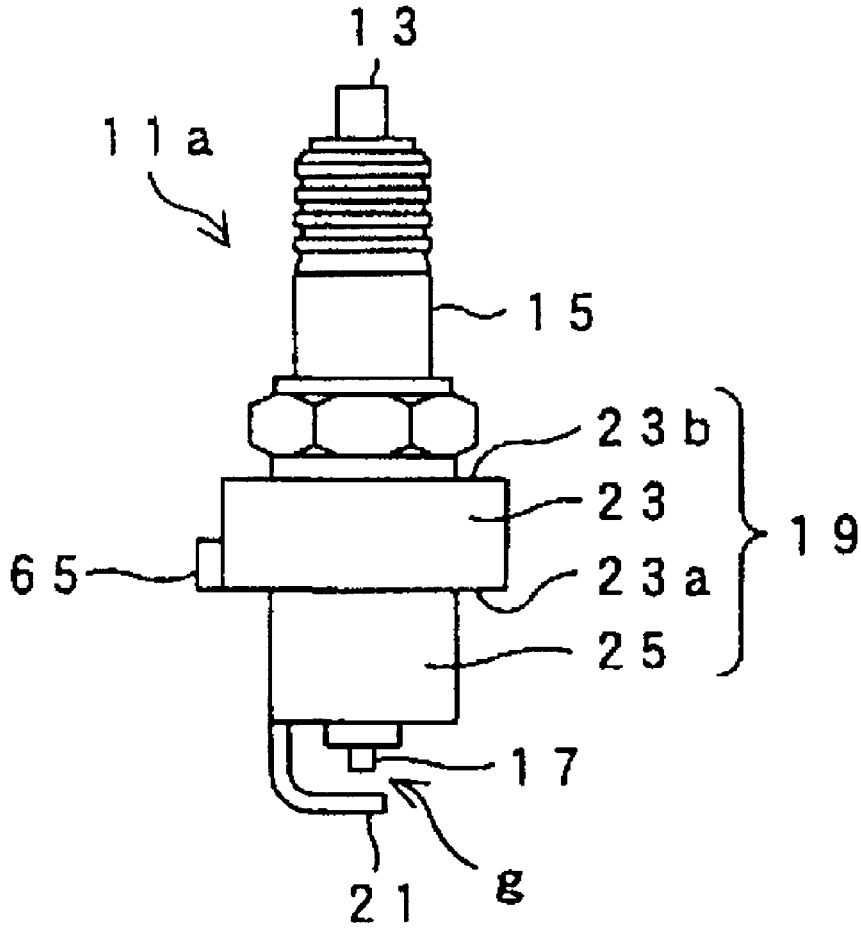
FIG. 5(*a*) is an exterior view of a second spark plug as viewed laterally.
Figure 5B:
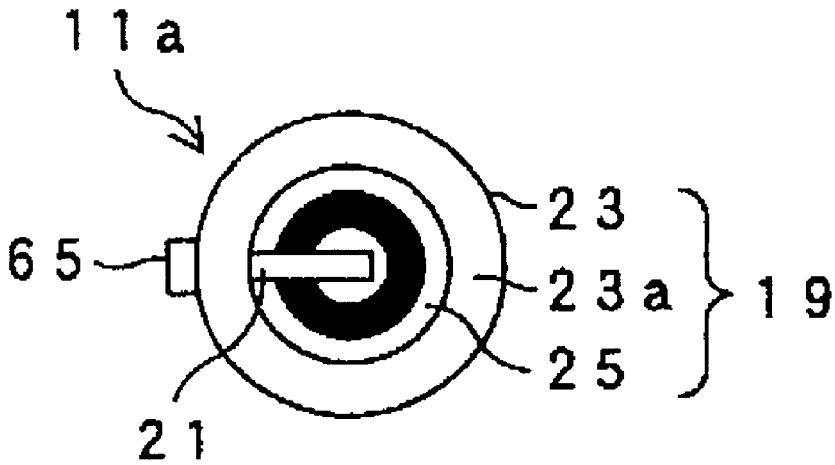
Figure 6A:
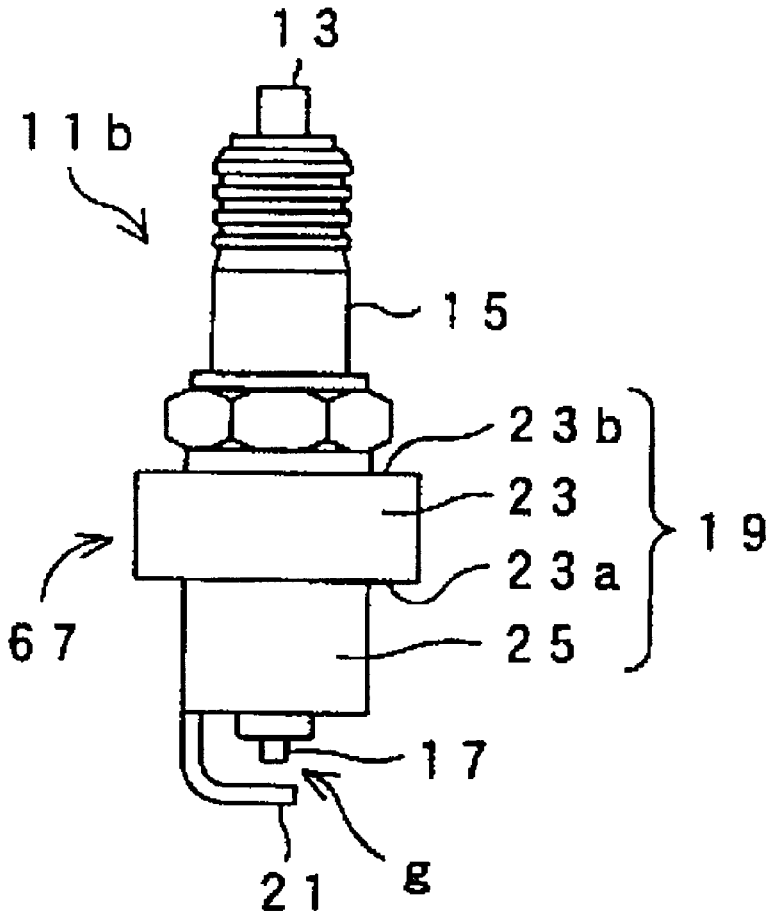
FIG. 6(*a*) is an exterior view of a third spark plug as viewed laterally.
Figure 6B:
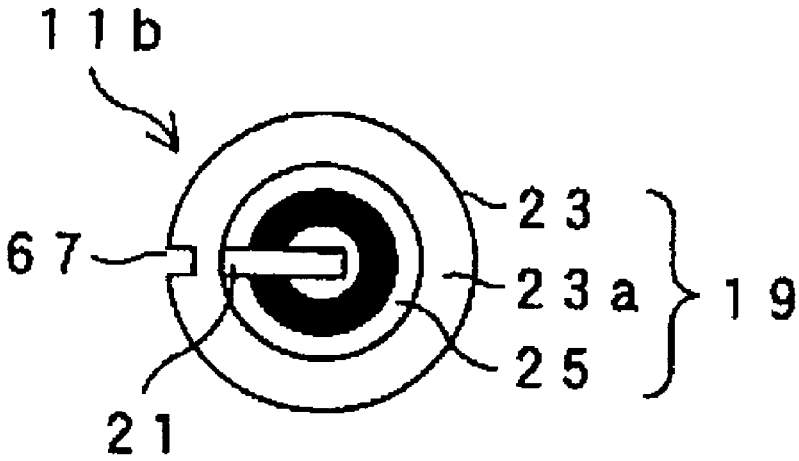
Figure 7A:
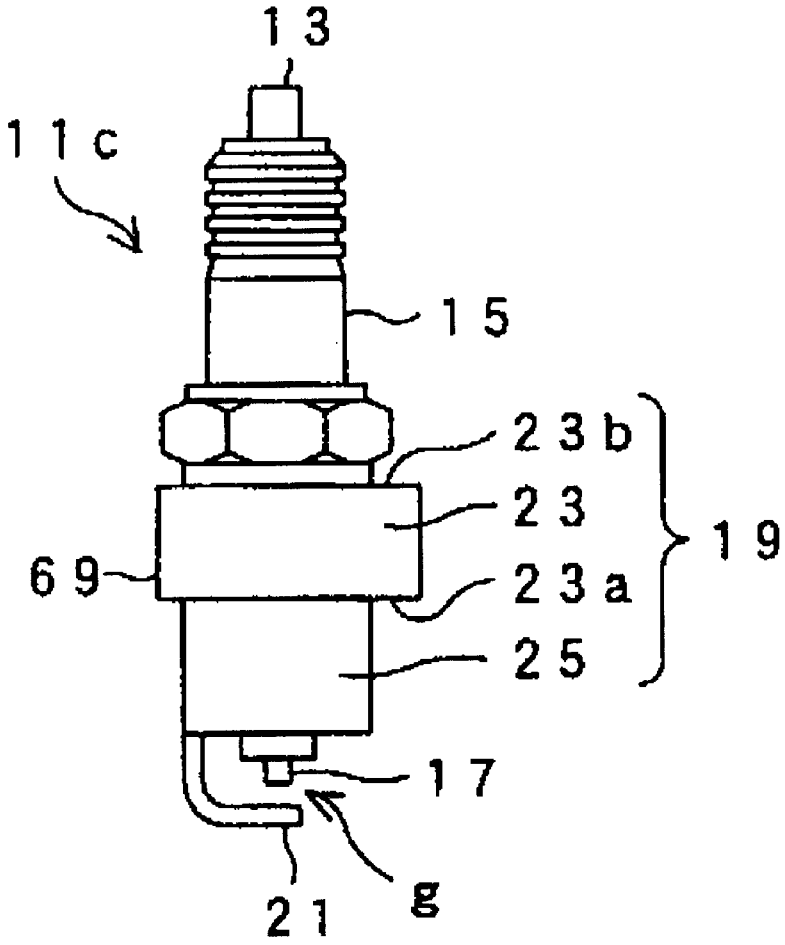
FIG. 7(*a*) is an exterior view of a fourth spark plug as viewed laterally.
Figure 7B:
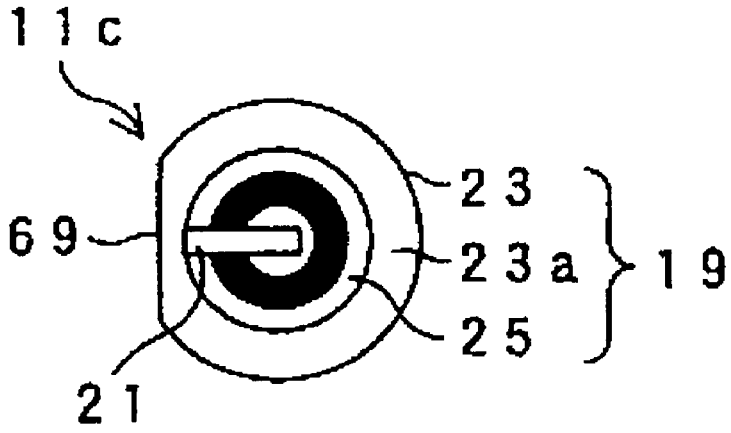

The spark plug 11 may assume the form of a second spark plug 11*a*, a third spark plug 11*b*, or a fourth spark plug 11*c* as shown in FIGS. 5, 6 and 7 in order that a position on the metallic shell 19 where the ground electrode 21 is joined is reliably set to a circumferentially specific position about the axis of the plug disposition hole 51*a* (i.e., the ground electrode 21 is reliably oriented in a specific direction within the combustion chamber 55).

First, in the second spark plug 11*a*, an axially extending protrusion 65 is formed on the outer circumferential side surface of the flange portion 23 of the metallic shell 19 and serves as an anti-rotation portion. FIG. 5(*a*) is an exterior view of the second spark plug 11*a* as viewed laterally, and FIG. 5(*b*) is an exterior view of the second spark plug 11*a* as viewed from the front end side (as viewed from below in FIG. 5(*a*)). Since the protrusion 65 is formed such that its position in relation to the ground electrode 21 is constant as shown in FIG. 5(*b*), by providing a mating groove, which is in an engaging relation with the protrusion 65 and serves as an anti-rotation reception portion, on the second wall surface 51*d* (see FIG. 1) of the plug disposition hole 51*a* of the cylinder head 51, the ground electrode 21 can be oriented in a constant direction within the combustion chamber 55 as follows: the second spark plug 11*a* is inserted into the plug disposition hole 51*a* while the protrusion 65 formed on the metallic shell 19 is engaged with the above-mentioned mating groove formed on the cylinder head 51. The position of the mating groove to be formed on the cylinder head 51 is determined beforehand such that a position on the metallic shell 19 where the ground electrode 21 is joined is set to a circumferentially specific position about the axis of the plug disposition hole 51*a*, and in view of the relative position between the ground electrode 21 and the protrusion 65.

As is apparent from FIG. 5(*b*), in the second spark plug 11*a*, the position of the protrusion 65 formed on the outer circumferential surface of the flange portion 23 of the metallic shell 19 is circumferentially aligned with the position of the joint between the ground electrode 21 and the metallic shell 19. However, the position of the protrusion 65 formed on the flange portion 23 is not necessarily circumferentially aligned with the position of the joint between the ground electrode 21 and the metallic shell 19. In this case, as mentioned above, the position of the mating groove to be formed on the cylinder head 51 must be determined as appropriate in view of the relative position between the ground electrode 21 and the protrusion 65 and specific orientation of the ground electrode 21 within the combustion chamber 55. In the second spark plug 11*a*, the protrusion 65 is formed on the outer circumferential side surface of the flange portion 23 of the metallic shell 19. However, the protrusion 65 may be formed on the outer circumferential surface of the front end portion 25 of the metallic shell 19. In this case, in order to correspond to a protrusion to be formed on the front end portion 25, a mating groove may be formed as appropriate on the first wall surface 51*c* of the plug disposition hole 51*a* formed in the cylinder head 51.

In the third spark plug 11*b*, a groove 67 is formed on the side surface of the flange portion 23 of the metallic shell 19 and serves as an anti-rotation portion. FIG. 6(*a*) is an exterior view of the third spark plug 11*b* as viewed laterally, and FIG. 6(*b*) is an exterior view of the third spark plug 11*b* as viewed from the front end side (as viewed from below in FIG. 6(*a*)). Since the groove 67 is formed such that its position in relation to the ground electrode 21 is constant as shown in FIG. 6(*b*), by providing a mating protrusion, which is in an engaging relation with the groove 67 and serves as an anti-rotation reception portion, on the second wall surface 51*d* (see FIG. 1) of the plug disposition hole 51*a* formed in the cylinder head 51, the ground electrode 21 can be oriented in a constant direction within the combustion chamber 55 as follows: the third spark plug 11*b* is inserted into the plug disposition hole 51*a* while the groove 67 formed on the metallic shell 19 is engaged with the above-mentioned mating protrusion formed on the cylinder head 51. The position of the mating protrusion to be formed on the cylinder head 51 is determined beforehand such that a position on the metallic shell 19 where the ground electrode 21 is joined is set to a circumferentially specific position about the axis of the plug disposition hole 51*a*, and in view of the relative position between the ground electrode 21 and the groove 67.

As is apparent from FIG. 6(*b*), in the third spark plug 11*b*, the position of the groove 67 formed on the outer circumferential surface of the flange portion 23 of the metallic shell 19 is circumferentially aligned with the position of the joint between the ground electrode 21 and the metallic shell 19. However, the position of the groove 67 formed on the flange portion 23 is not necessarily circumferentially aligned with the position of the joint between the ground electrode 21 and the metallic shell 19. In this case, as mentioned above, the position of the mating protrusion to be formed on the cylinder head 51 must be determined as appropriate in view of the relative position between the ground electrode 21 and the groove 67 and specific orientation of the ground electrode 21 within the combustion chamber 55. In the third spark plug 11*b*, the groove 67 is formed on the outer circumferential side surface of the flange portion 23 of the metallic shell 19. However, the groove 67 may be formed on the outer circumferential surface of the front end portion 25 of the metallic shell 19. In this case, in order to correspond to a groove to be formed on the front end portion 25, a mating protrusion may be formed as appropriate on the first wall surface 51*c* of the plug disposition hole 51*a* formed in the cylinder head 51.

In the fourth spark plug 11*c*, a flat portion 69 is formed on the side surface of the flange portion 23 of the metallic shell 19 and serves as an anti-rotation portion. FIG. 7(*a*) is an exterior view of the fourth spark plug 11*c* as viewed laterally, and FIG. 7(*b*) is an exterior view of the fourth spark plug 11*c* as viewed from the front end side. Since the flat portion 69 is formed such that its position in relation to the ground electrode 21 is constant as shown in FIG. 7(*b*), by providing a mating flat portion, which faces the flat portion 69 in an engaging relation with the flat portion 69 and serves as an anti-rotation reception portion, on the second wall surface 51*d* (see FIG. 1) of the plug disposition hole 51*a* formed in the cylinder head 51, the ground electrode 21 can be oriented in a constant direction within the combustion chamber 55 as follows: the fourth spark plug 11*c* is inserted into the plug disposition hole 51*a* while the flat portion 69 formed on the metallic shell 19 is engaged with the above-mentioned mating flat portion formed on the cylinder head 51. The position of the mating flat portion to be formed on the cylinder head 51 is determined beforehand such that a position on the metallic shell 19 where the ground electrode 21 is joined is set to a circumferentially specific position about the axis of the plug disposition hole 51*a*, and in view of the relative position between the ground electrode 21 and the flat portion 69.

As is apparent from FIG. 7(*b*), in the fourth spark plug 11*c*, the position of the flat portion 69 formed on the outer circumferential surface of the flange portion 23 of the metallic shell 19 is circumferentially aligned with the position of the joint between the ground electrode 21 and the metallic shell 19. However, the position of the flat portion 69 formed on the flange portion 23 is not necessarily circumferentially aligned with the position of the joint between the ground electrode 21 and the metallic shell 19. In this case, as mentioned above, the position of the mating flat portion to be formed on the cylinder head 51 must be determined as appropriate in view of the relative position between the ground electrode 21 and the flat portion 69 and specific orientation of the ground electrode 21 within the combustion chamber 55.

In the fourth spark plug 11*c*, the flange portion 23 of the metallic shell 23 assumes a section (a section taken along a plane perpendicular to the axial direction of the fourth spark plug 11*c*) whose shape is a circle which is partially cut off. However, the section of the flange portion 23 may assume a shape other than circle, such as polygon (hexagon, etc.) or oval. A corresponding portion of the plug disposition hole 51*a* (see FIG. 1) formed in the cylinder head 51 may assume a sectional shape such that the flange portion 23 of a spark plug can be disposed therein.

Next will be described a second embodiment; i.e., an ignition apparatus for use in an internal combustion engine which includes a second plug hole pipe 73 having a flange portion 75. The spark plug 11 included in the ignition apparatus for use in an internal combustion engine of the second embodiment is configured in a manner similar to that of the spark plug of the first embodiment. An intake-valve-exhaust-valve drive mechanism to be provided on the cylinder head 51 is configured in a manner similar to that of the first embodiment, and therefore redundant description thereof is omitted.

Figure 3:
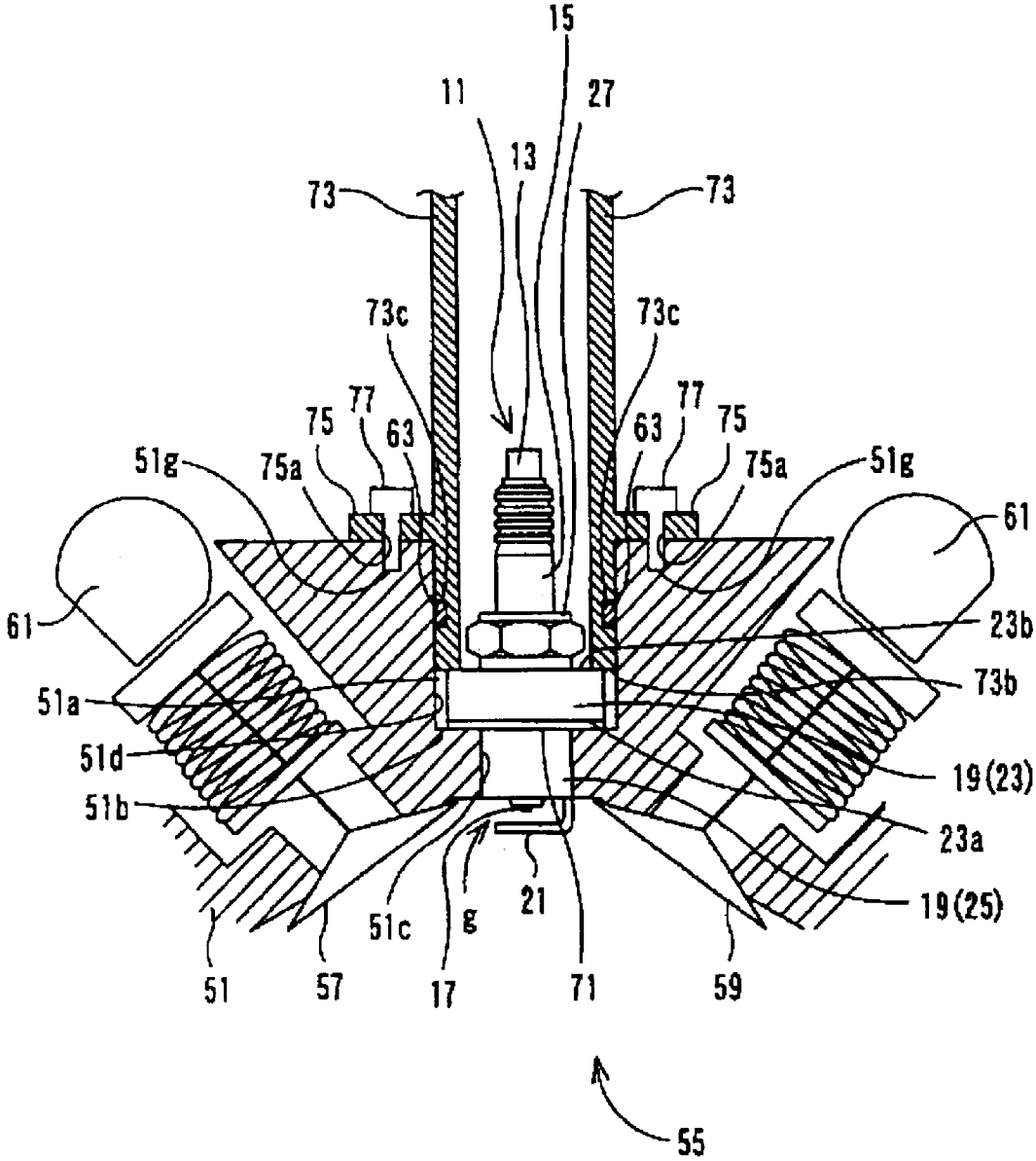
FIG. 3 is a sectional view of a cylinder head in which a second plug hole pipe having a flange portion and a spark plug are disposed.

FIG. 3 is a sectional view of the cylinder head 51 in which the second plug hole pipe 73 having the flange portion 75 and the spark plug 11 are disposed.

As shown in FIG. 3, the second plug hole pipe 73 includes the flange portion 75, which projects radially outward from the outer circumferential surface of the same. Through-holes 75*a* for allowing insertion of corresponding bolts 77 are formed in the flange portion 75. The flange portion 75 may be formed along the entire circumference of the second plug hole pipe 73 in such a manner as to project radially outward as in the case of the present embodiment, or one or more flange portions 75 may be formed intermittently along the entire circumference in such a manner as to project outward.

The length of a portion of the second plug hole pipe 73 extending between a front end 73*b* and the front end face of the flange portion 75 is set longer than a length obtained by subtracting the axial length of the flange portion 23 of the spark plug 11 and the axial length (thickness) of the gasket 71 as measured before elastic deformation thereof from the axial length of the second wall surface 51*d* of the plug disposition hole 51*a*. By so doing, when the flange portion 75 is fixedly attached to the cylinder head 51 by use of the bolts 77, at least the front end 73*b* of the second plug hole pipe 73 can abut the rear end face 23*b* of the flange portion 23 and thus can cause the plug seat 23*a* of the spark plug 11 to be pressed against the cylinder head 51 (specifically, the step face 51*b* of the plug disposition hole 51*a*). By fixedly attaching the second plug hole pipe 73 to the cylinder head 51, the spark plug 11, whose metallic shell 19 has no thread grooves formed thereon, is fixedly attached to the cylinder head 51 while the plug seat 23*a* of the spark plug 11 is pressed against the cylinder head 51 as described above.

The flange portion 75 of the second plug hole pipe 73 is fixedly attached to the cylinder head 51 by use of the bolts 77, which are screw-engaged with the cylinder head 51 through the corresponding through-holes 75*a*. Female-threaded portions 51*g*, which can be screw-engaged with the corresponding bolts 77, are formed on the cylinder head 51.

The oil seal 63 is disposed between an outer circumferential surface of the second plug hole pipe 73 extending between the flange portion 75 and the front end 73*b* and the second wall surface 51*d* of the plug disposition hole 51*a* formed in the cylinder head 51, to thereby prevent penetration of lubricating oil. Notably, the plug disposition hole 51*a* formed in the cylinder head 51 of the second embodiment includes the first wall surface 51*c* and the second wall surface 51*d*, but does not include a third wall surface in contrast to the plug disposition hole 51*a* of the first embodiment. The oil seal 63 is disposed while being fitted into a groove 73*c* formed circumferentially on the outer circumferential surface of the second plug hole pipe 73. In the course of fixedly attaching the second hole pipe 73 to the cylinder head 51 by use of the flange portion 75, the oil seal 63 is elastically deformed while being held between the second plug hole pipe 73 and the second wall surface 51*d* of the plug disposition hole 51*a*.

As described above, the ignition apparatus for use in an internal combustion engine of the second embodiment is configured such that, by fixedly attaching the flange portion 75 to the cylinder head 51 by use of the bolts 77, the second plug hole pipe 73 is fixedly attached to the cylinder head 51. Removal of the bolts 77 allows the fixedly attached second plug hole pipe 73 to be removed from the cylinder head 51.

Thus, as in the case of the ignition apparatus for use in an internal combustion engine of the first embodiment, according to the ignition apparatus for use in an internal combustion engine of the second embodiment, in the course of attachment of the spark plug 11 to the cylinder head 51 the ground electrode 21 can be oriented in a direction of optimal ignition within the combustion chamber 55, and the spark plug 11 can be replaced. Therefore, the ignition apparatus of the second embodiment is applicable to various kinds of internal combustion engines.

Next will be described a third embodiment; i.e., an ignition apparatus for use in an internal combustion engine which includes a third plug hole pipe 79 having thread grooves 81 formed on the outer circumferential surface thereof. The spark plug 11 included in the ignition apparatus for use in an internal combustion engine of the third embodiment is configured in a manner similar to that of the spark plug of the first embodiment. An intake-valve-exhaust-valve drive mechanism to be provided on the cylinder head 51 is configured in a manner similar to that of the first embodiment, and therefore redundant description thereof is omitted.

Figure 4:
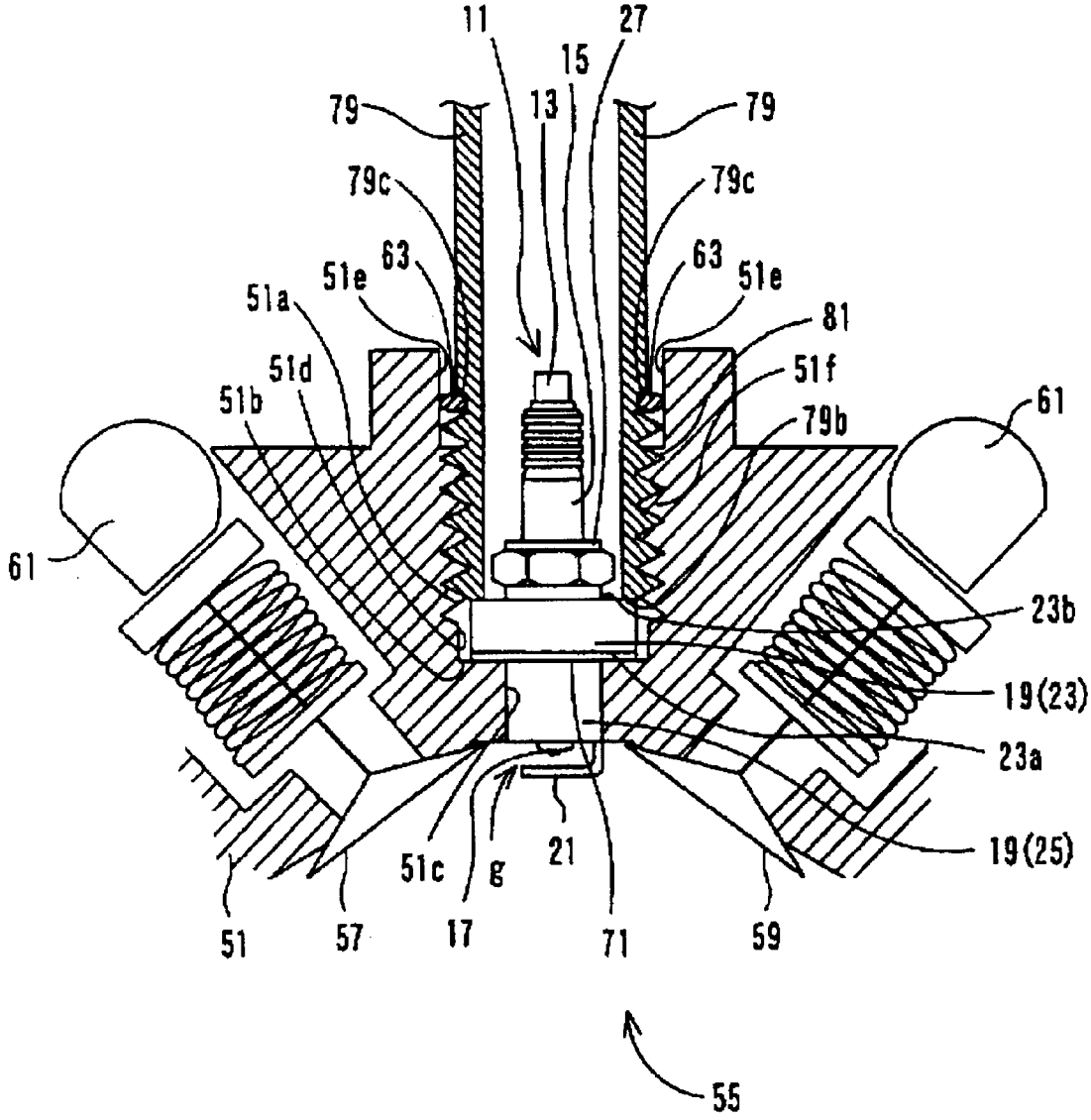
FIG. 4 is a sectional view of a cylinder head in which a third plug hole pipe having thread grooves formed on an outer circumferential surface thereof and a spark plug are disposed.

FIG. 4 is a sectional view of the cylinder head 51 in which the third plug hole pipe 79 and the spark plug 11 are disposed.

As shown in FIG. 4, the third plug hole pipe 79 has the thread grooves 81 formed on the outer circumferential surface of a portion thereof located in the vicinity of a front end 79*b* thereof. Thread grooves 51*f*, which can be engaged with the thread grooves 81 formed on the third plug hole pipe 79, are formed on the second wall surface 51*d* of the plug disposition hole 51*a* formed in the cylinder head 51.

The axial length of the threaded grooves 81 formed on the outer circumferential surface of the third plug hole pipe 79 and extending axially rearward (upward in FIG. 4) from the front end 79*b* is set longer than the axial length of the threaded grooves 51*f* of the plug disposition hole 51*a*. By so doing, when the third plug hole pipe 79 is screw-engaged with the cylinder head 51, at least the front end 79*b* of the third plug hole pipe 79 can abut the rear end face 23*b* of the flange portion 23 and thus can cause the plug seat 23*a* of the spark plug 11 to be pressed against the cylinder head 51 (specifically, the step face 51*b* of the plug disposition hole 51*a*). By fixedly attaching the third plug hole pipe 79 to the cylinder head 51 through screw engagement, the spark plug 11, whose metallic shell 19 has no thread grooves formed thereon, is fixedly attached to the cylinder head 51 while the plug seat 23*a* of the spark plug 11 is pressed against the cylinder head 51 as described above.

The oil seal 63 is disposed between an outer circumferential surface of the third plug hole pipe 79 located rearward in relation to the threaded grooves 81 and the third wall surface 51*e* of the plug disposition hole 51*a* formed in the cylinder head 51, to thereby prevent penetration of lubricating oil. The oil seal 63 is disposed while being fitted into a groove 79*c* formed circumferentially on the outer circumferential surface of the third plug hole pipe 79. In the course of fixedly attaching the third plug hole pipe 79 to the cylinder head 51 through screw engagement, the oil seal 63 is elastically deformed while being held between the third plug hole pipe 79 and the third wall surface 51*e* of the plug disposition hole 51*a*.

As described above, the ignition apparatus for use in an internal combustion engine of the third embodiment employs screw engagement which is effected by use of the threaded grooves 81, as a method for fixedly attaching the third plug hole pipe 79 to the cylinder head 51. This fixation method allows removal of the fixedly attached third plug hole pipe 79 from the cylinder head 51 and enables fixation of a plug hole pipe onto a cylinder head without use of additional members such as bolts.

The third plug hole pipe 79 is fixedly attached to the cylinder head 51 through screw engagement of the threaded grooves 81 with the cylinder head 51; i.e., the plug hole pipe itself has a portion in direct contact with the cylinder head. Therefore, the oil seal 63 can be omitted.

According to the employed method, a plug hole pipe is fixedly attached to a cylinder head through screw engagement. Therefore, through control of torque applied for tightening the third plug hole pipe 79 into the cylinder head 51, a force (load) to be applied to the spark plug 11 by the third plug hole pipe 79 can be rendered substantially constant, whereby the third plug hole pipe 79 can cause the plug seat 23*a* of the metallic shell 19 to be pressed against the cylinder head 51 stably and without variations among spark plugs.

Notably, when the third plug hole pipe 79 is fixedly attached to the cylinder head 51, the third plug hole pipe 79 rotates. Accordingly, if a spark plug is of a type that is rotatable in the plug disposition hole 51*a*, the spark plug will rotate with the third plug hole pipe 79, potentially resulting in change in the orientation of the ground electrode 21 in relation to the cylinder head 51. Therefore, preferably, when the third plug hole pipe 79 is to be used, a spark plug is of a type that does not rotate in the plug disposition hole 51*a*. Specifically, by use of a spark plug of a type that is shown in FIG. 5, a change in the orientation of a ground electrode can be prevented.

Next will be described a fourth embodiment; i.e., an ignition apparatus for use in an internal combustion engine which includes a fourth plug hole pipe 91 having thread grooves formed on the outer circumferential surface thereof as in the case of the third embodiment and including a front end portion 91*c*, which abuts the crimped portion 27 of the metallic shell 19 of the spark plug 11. The spark plug 11 included in the ignition apparatus for use in an internal combustion engine of the fourth embodiment is configured in a manner similar to that of the spark plug of the first embodiment except that the flange portion 23 is smaller in size. An intake-valve-exhaust-valve drive mechanism to be provided on the cylinder head 51 is configured in a manner similar to that of the first embodiment, and therefore redundant description thereof is omitted.

Figure 8:
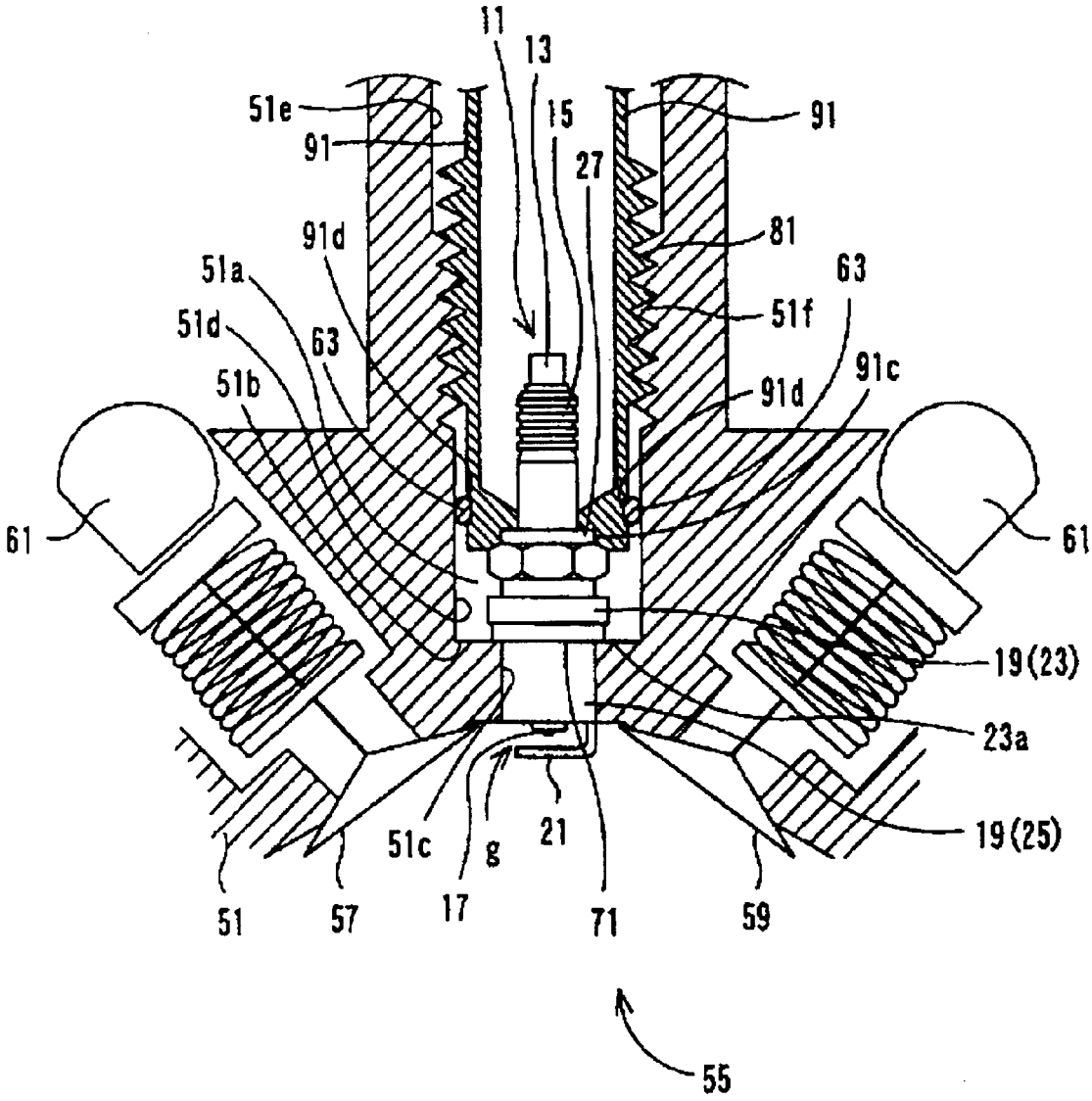
FIG. 8 is a sectional view of a cylinder head in which a fourth plug hole pipe and a spark plug are disposed, showing a structure in that a front end portion of the fourth plug hole pipe abuts a crimped portion of the spark plug.

FIG. 8 is a sectional view of the cylinder head 51 in which the fourth plug hole pipe 91 and the spark plug 11 are disposed.

As shown in FIG. 8, the fourth plug hole pipe 91 has the thread grooves 81 formed on the outer circumferential surface of a portion thereof located in the vicinity of the front end portion 91*c* thereof. The thread grooves 51*f*, which can be engaged with the thread grooves 81 formed on the fourth plug hole pipe 91, are formed on the third wall surface 51*e* of the plug disposition hole 51*a* formed in the cylinder head 51. The front end portion 91*c* of the fourth plug hole pipe 91 is formed in such a manner as to project inward from the inner wall of the fourth plug hole pipe 91 and adjusted in shape such that the same can abut the crimped portion 27 of the metallic shell 19 as will be described later in this specification.

The axial length of a portion of the outer circumferential surface of the fourth plug hole pipe 91 on which the threaded grooves 81 are formed is set longer than the axial length of the threaded grooves 51*f* of the plug disposition hole 51*a*. By so doing, when the fourth plug hole pipe 91 is screw-engaged with the cylinder head 51, at least the front end portion 91*c* of the fourth plug hole pipe 91 can abut the crimped portion 27 of the flange portion 23 and thus can cause the plug seat 23*a* of the spark plug 11 to be pressed against the cylinder head 51 (specifically, the step face 51*b* of the plug disposition hole 51*a*). By fixedly attaching the fourth plug hole pipe 91 to the cylinder head 51 through screw engagement, the spark plug 11, whose metallic shell 19 has no thread grooves formed thereon, is fixedly attached to the cylinder head 51 while the plug seat 23*a* of the spark plug 11 is pressed against the cylinder head 51 as described above.

The oil seal 63 is disposed between an outer circumferential surface of the fourth plug hole pipe 91 located frontward in relation to the threaded grooves 81 and the second wall surface 51*d* of the plug disposition hole 51*a* formed in the cylinder head 51, to thereby prevent penetration of lubricating oil. The oil seal 63 is disposed while being fitted into a groove 91*d* formed circumferentially on the outer circumferential surface of the fourth plug hole pipe 91. In the course of fixedly attaching the fourth plug hole pipe 91 to the cylinder head 51 through screw engagement, the oil seal 63 is elastically deformed while being held between the fourth plug hole pipe 91 and the second wall surface 51*d* of the plug disposition hole 51*a*.

The fourth plug hole pipe 91 is fixedly attached to the cylinder head 51 through screw engagement of the threaded grooves 81 with the cylinder head 51; i.e., the plug hole pipe itself has a portion in direct contact with the cylinder head. Therefore, the oil seal 63 can be omitted.

As described above, in addition to the above-described effect yielded by the ignition apparatus for use in an internal combustion engine of the third embodiment, the ignition apparatus for use in an internal combustion engine of the fourth embodiment allows reduction in the outside diameter of a plug hole pipe (the fourth plug hole pipe 91) as compared with a structure in that a plug hole pipe is caused to abut the rear end face 23*b* of the flange portion 23 of the metallic shell 19 as in the case of the internal combustion engine of the third embodiment. Thus, a space which a plug hole pipe itself occupies within the cylinder head 51 can be reduced, and a space for disposing other devices, such as an intake-valve-exhaust-valve mechanism, can be increased accordingly. Therefore, the ignition apparatus for use in an internal combustion engine becomes an optimum ignition apparatus for use in an internal combustion engine of high output.

Figure 9:
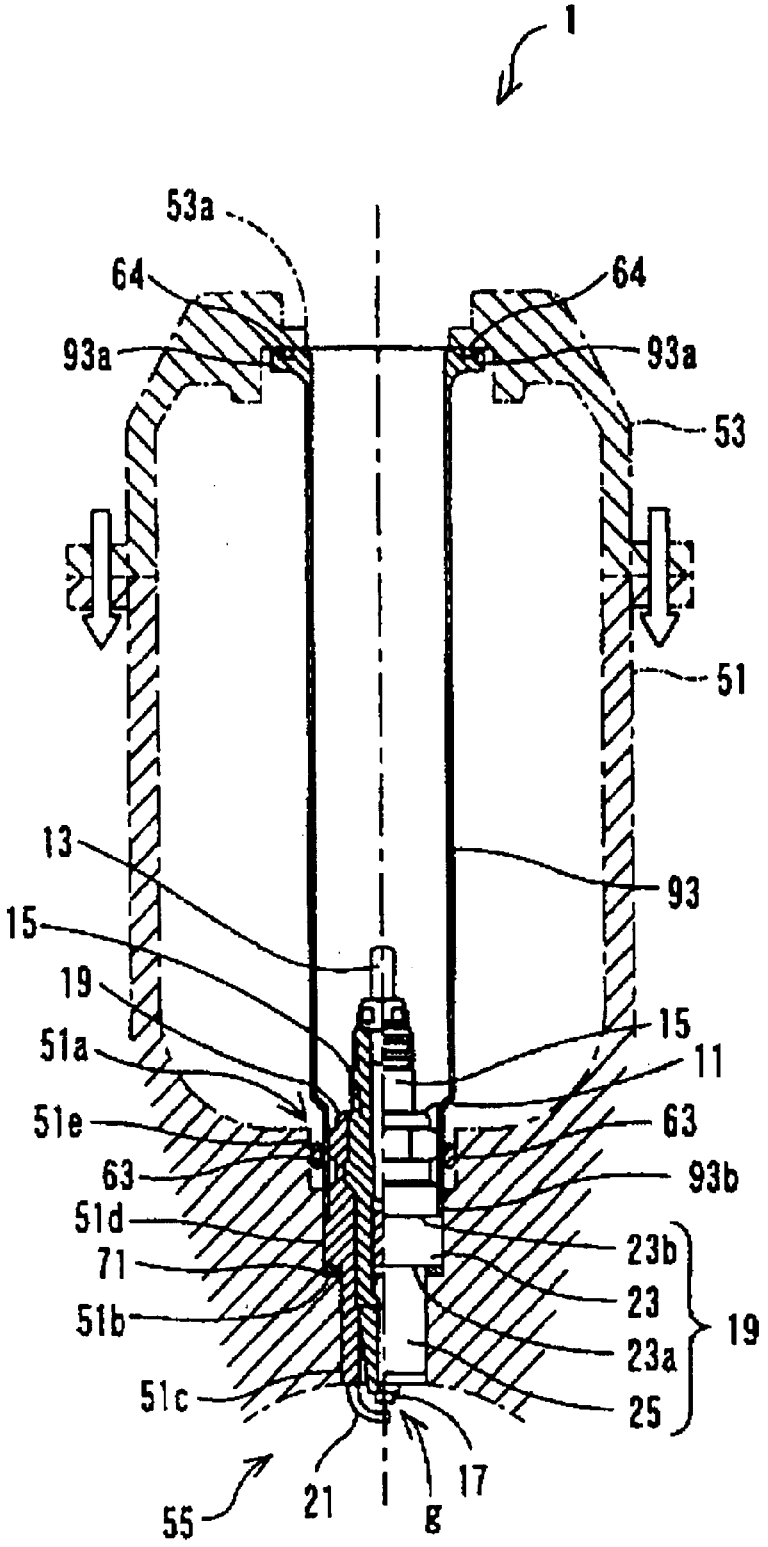
FIG. 9 is an explanatory view showing the state of attachment, to a cylinder head, of a spark plug and a plug hole pipe included in an ignition apparatus for use in an internal combustion engine of a fifth embodiment.

Next will be described a fifth embodiment; i.e., an ignition apparatus for use in an internal combustion engine which includes a fifth plug hole pipe 93 formed into a cylindrical shape as shown in FIG. 9 and in which a force associated with fixation of the cylinder head cover 53 onto the cylinder head 51 with the fifth plug hole pipe 93 being held therebetween is used for fixedly attaching the fifth plug hole pipe 93 to (for retaining the same in) the cylinder head 51. The spark plug 11 included in the ignition apparatus for use in an internal combustion engine of the fifth embodiment is configured in a manner similar to that of the spark plug of the first embodiment. An intake-valve-exhaust-valve drive mechanism to be provided on the cylinder head 51 is configured in a manner similar to that of the first embodiment, and therefore redundant description thereof is omitted.

FIG. 9 is a sectional view of the cylinder head 51 in which the fifth plug hole pipe 93 and the spark plug 11 are disposed and on which the cylinder head cover 53 is provided.

As shown in FIG. 9, the fifth plug hole pipe 93 is formed into a cylindrical shape in such a manner as to open at a front end 93*b* and a rear end 93*a*. The rear end 93*a* is formed such that the outside diameter thereof is rendered greater than that of an axially intermediate, cylindrical portion of the fifth plug hole pipe 93, thereby being able to abut the circumferential inner wall of the opening portion 53*a* of the cylinder head cover 53. A front end portion of the fifth plug hole pipe is formed such that the diameter thereof is rendered smaller than that of the cylindrical portion, and the front end 93*b* can abut the rear end face 23*b*, located opposite the plug seat 23*a,* of the flange portion 23 of the metallic shell 19 of the spark plug 11. The diameter-reduced front end portion of the fifth plug hole pipe 93 assumes an outside diameter smaller than the inside diameter of the second wall surface 51*d* of the plug disposition hole 51*a* formed in the cylinder head 51. After the spark plug 11 is disposed in the cylinder head 51, the fifth plug hole pipe 93 is loosely fitted into the plug disposition hole 51*a* such that the front end 93*b* abuts the rear end face 23*b* of the metallic shell 19 of the spark plug 11.

The ignition apparatus for use in an internal combustion engine of the fifth embodiment is assembled in the following manner. The spark plug 11, whose metallic shell 19 has no thread grooves formed thereon, is disposed in the plug disposition hole 51*a* formed in the cylinder head 51. Next, the above-described fifth plug hole pipe 93 is inserted into the plug disposition hole 51*a*. Subsequently, the cylinder head cover 53 is fixedly attached to an upper portion (located at the upside of FIG. 9) of the cylinder head 51. In this case, the axial length of the fifth plug hole pipe 93 must be adjusted beforehand such that, when the cylinder head cover 53 is fixedly attached onto the cylinder head 51, the fifth plug hole pipe 93 and the spark plug 11 (including the gasket 71 if provided) can be held together between the cylinder head cover 53 and the cylinder head 51.

By determining beforehand the axial length of the fifth plug hole pipe 93 in view of the axial length of the flange portion 23 of the spark plug 11 (including the thickness of the gasket 71 when the gasket 71 is provided as in the case of the present embodiment), the dimension of the cylinder head 51, and the dimension of the cylinder head cover 53, when the cylinder head cover 53 is fixedly attached onto the cylinder head 51, the fifth plug hole pipe 93, together with the spark plug 11, is held between the cylinder head cover 53 and the cylinder head 51. As a result, the fifth plug hole pipe 93 causes the plug seat 23*a* of the spark plug 11 to be pressed against the cylinder head 51 (specifically, the step face 51*b* of the plug disposition hole 51*a*) while the front end 93*b* of the fifth plug hole pipe 93 abuts the rear end face 23*b* of the flange portion 23 of the metallic shell 19 of the spark plug 11, whereby the spark plug 11, whose metallic shell 19 has no thread grooves formed thereon, is fixedly attached to the cylinder head 51 by use of the fifth plug hole pipe 93.

The oil seal 63 is disposed between the outer circumferential surface of the diameter-reduced front end portion of the fifth plug hole pipe 93 and the third wall surface 51*e* of the plug disposition hole 51*a* formed in the cylinder head 51, thereby preventing penetration of lubricating oil. The oil seal 63 is disposed while being fitted into a groove (not shown) formed circumferentially on the outer circumferential surface of the fifth plug hole pipe 93. In the course of insertion of the fifth plug hole pipe 93 into the plug disposition hole 51*a* formed in the cylinder head 51, the oil seal 63 is elastically deformed while being held between the fifth plug hole pipe 93 and the third wall surface 51*e* of the plug disposition hole 51*a*.

A second oil seal 64 for preventing penetration of lubricating oil is also provided between the rear end 93*a* of the fifth plug hole pipe 93 and the circumferential inner wall of the opening portion 53*a* of the cylinder head cover 53. The second oil seal 64 prevents leakage of lubricating oil along the interface between the rear end 93*a* of the fifth plug hole pipe 93 and the cylinder head cover 53, thereby preventing lubricating oil from entering from the rear end 93*a* and reaching the spark plug 11. Although, in this embodiment, the plug hole pipe 93 and the cylinder head cover are separate parts, but they can be formed of a single part, or can be jointed together by welding or brazing.

As described above, the ignition apparatus for use in an internal combustion engine of the fifth embodiment employs the following method for fixedly attaching the fifth plug hole pipe 93 to the cylinder head 51: the fifth plug hole pipe 93 is held between the cylinder head 51 and the cylinder head cover 53, which is fixedly attached onto the cylinder head 51. This fixation method allows removal of the fixedly attached fifth plug hole pipe 93 from the cylinder head 51 and enables fixation of a plug hole pipe onto a cylinder head without use of additional members such as bolts. Since the cylinder head cover 53 is fixedly attached onto the cylinder head 51 to thereby hold the fifth plug hole pipe 93 and the spark plug 11 together therebetween, the fifth plug hole pipe 93 can cause the plug seat 23*a* of the metallic shell 19 of the spark plug 11 to be stably pressed against the cylinder head 51, thereby maintaining good seal between the spark plug 11 and the cylinder head 51 and enabling stable contact between the plug seat 23*a* (specifically, the plug seat 23*a* via the gasket 71) of the spark plug 11 and the cylinder head 51 even when vibration of an internal combustion engine is propagated to the spark plug 11. As a modified embodiment, a part of the cylinder head cover may be held between a cylinder head and a rear end of a plug hole pipe. By such a structure, the cylinder head cover can be pressed onto the cylinder head by the rear end of the plug hole pipe.

While the present invention has been described with reference to the first through fifth embodiments, the present invention is not limited thereto, but may be embodied in various forms.

For example, the second plug hole pipe 73 of the second embodiment uses bolts for fixedly attaching the flange portion 75 to the cylinder head 51. However, the fixation method is not limited thereto. Any method that allows removal after fixation may be employed. Specifically, an engagement portion may be formed on the cylinder head 51 such that, after the spark plug 11 is held between the second plug hole pipe 73 and the cylinder head 51, turning of the second plug hole pipe 73 about the center axis causes the flange portion 75 to be engaged with the same.

In the ignition apparatus for use in an internal combustion engine of the first through fourth embodiments, the gasket 71 is held between the plug seat 23*a* of the spark plug 11 and the cylinder head 51. However, the spark plug 11 may be of a type that a plug seat tapers frontward between the flange portion 23 and the front end portion 25 of the metallic shell 19, whereby the plug seat is brought in direct contact with the cylinder head 51 without use of the gasket 71 (so-called conical seat type). Furthermore, the flange portion 23 or crimped portion 27 of the metallic shell 19 and the plug hole pipe 93 may be jointed together by welding or brazing.

The ignition apparatus for use in an internal combustion engine of the fourth embodiment is described while describing a fixation method for a spark plug in which a plug hole pipe is caused to abut the crimped portion 27 of the metallic shell 19. Application of this fixation method for a spark plug is not limited to the ignition apparatus of the fourth embodiment, in which the plug hole pipe is fixedly attached to the cylinder head 51 through screw engagement. Needless to say, this fixation method may be applicable to an ignition apparatus in which a plug hole pipe is press-fitted into the cylinder head 51 as in the case of the first embodiment, an ignition apparatus in which a plug hole pipe is fixedly attached to the cylinder head 51 by use of the flange portion 75 as in the case of the second embodiment, or the ignition apparatus of the fifth embodiment.

This application is based on Japanese Patent Application No. 2001-131704 filed Apr. 27, 2001, the disclosure of which is incorporated herein by reference in its entirety.

What is claimed is:

1. An ignition apparatus for use in an internal combustion engine, comprising a spark plug, which comprises a center electrode disposed at a front end portion of an axial hole formed in an insulator, a metallic shell provided outside the insulator, and a ground electrode joined to the metallic shell and forming a spark discharge gap between the ground and center electrodes, and which spark plug is disposable in a plug disposition hole formed in a cylinder head of the internal combustion engine, said cylinder head containing lubricating oils, the ignition apparatus being adapted to induce spark discharge in the spark discharge gap of the spark plug for igniting an air-fuel mixture, the ignition apparatus being characterized in that:

the metallic shell of the spark plug comprises a flange portion having a plug seat formed on a front end face thereof and adapted to come in contact with the cylinder head directly or indirectly via another member, and a front end portion extending axially frontward from the plug seat of the flange portion, receivable in the plug disposition hole, and having no thread grooves formed on an outer circumferential surface thereof; and in that a plug hole pipe is provided, which is disposable rearward in relation to the plug seat of the metallic shell and is fixedly attachable to the cylinder head, said plug hole pipe isolating the spark plug from lubricating oils in the cylinder head and causing the plug seat of the metallic shell to be pressed against the cylinder head, whereby the spark plug is fixedly attachable to the cylinder head.

2. The ignition apparatus for use in an internal combustion engine as claimed in claim 1, wherein the plug hole pipe disposable rearward in relation to the plug seat of the metallic shell, in use, abuts and presses a portion of the metallic shell to thereby fixedly attach the spark plug to the cylinder head.

3. The ignition apparatus for use in an internal combustion engine as claimed in claim 2, wherein the plug hole pipe, in use, accommodates a portion of the spark plug which extends rearward from a rear end face of the flange portion of the metallic shell, the rear end face being an end face located opposite the plug seat, and abuts and presses the rear end face of the flange portion of the metallic shell to thereby fixedly attach the spark plug to the cylinder head.

4. The ignition apparatus for use in an internal combustion engine as claimed in claim 2, wherein the metallic shell comprises a crimped portion, which is formed by crimping a circumferential edge of a rear end portion thereof toward an outer circumferential portion of the insulator, and the plug hole pipe, in use, accommodates a portion of the spark plug which extends rearward from the crimped portion of the metallic shell, and abuts and presses the crimped portion to thereby fixedly attach the spark plug to the cylinder head.

5. The ignition apparatus for use in an internal combustion engine as claimed in claim 1, wherein the plug hole pipe is fixedly attachable to the cylinder head through press fitting.

6. The ignition apparatus for use in an internal combustion engine as claimed in claim 1, wherein the plug hole pipe comprises a flange portion projecting outward from an outer circumferential surface thereof, and the flange portion is fixedly attachable to the cylinder head, whereby the plug hole pipe is fixedly attachable to the cylinder head.

7. The ignition apparatus for use in an internal combustion engine as claimed in claim 1, wherein the plug hole pipe has thread grooves formed on an outer circumferential surface thereof, and the thread grooves are engagable with thread grooves formed on the cylinder head, whereby the plug hole pipe is fixedly attachable to the cylinder head.

8. The ignition apparatus for use in an internal combustion engine as claimed in claim 1, wherein a cylinder head cover is provided on the cylinder head, and the plug hole pipe and cylinder head cover are adapted such that, in use, the plug hole pipe is held between the cylinder head cover and the cylinder head to thereby be fixedly attached to the cylinder head.

9. The ignition apparatus for use in an internal combustion engine as claimed in claim 1, wherein the spark plug is configured such that the metallic shell comprises an anti-rotation portion which is engagable with the cylinder head at one or more positions when the spark plug is turned about an axis of the plug disposition hole in the course of attachment to the cylinder head; the cylinder head comprises an anti-rotation reception portion corresponding to the anti-rotation portion; and when the spark plug is fixedly attached to the cylinder head, a position of a joint between the metallic shell and the ground electrode is aligned with a predetermined circumferential position about an axis of the plug disposition hole.

10. The ignition apparatus for use in an internal combustion engine as claimed in claim 1, comprising an oil seal member provided between the plug hole pipe and the cylinder head.

11. The ignition apparatus for use in an internal combustion engine as claimed in claim 1, comprising a gasket arranged between the plug seat of the metallic shell of the spark plug and the cylinder head.

12. An ignition apparatus for use in an internal combustion engine, comprising a spark plug, which comprises a center electrode disposed at a front end portion of an axial hole formed in an insulator, a metallic shell provided outside the insulator, and a ground electrode joined to the metallic shell and forming a spark discharge gap between the ground and center electrodes, and which spark plug is disposable in a plug disposition hole formed in a cylinder head of the internal combustion engine, the ignition apparatus being adapted to induce spark discharge in the spark discharge gap of the spark plug for igniting an air-fuel mixture, the ignition apparatus being characterized in that:

the metallic shell of the spark plug comprises a flange portion having a plug seat formed on a front end face thereof and adapted to come in contact with the cylinder head directly or indirectly via another member, and a front end portion extending axially frontward from the plug seat of the flange portion, receivable in the plug disposition hole, and having no thread grooves formed on an outer circumferential sufface thereof; and in that a plug hole pipe is provided, which is disposable rearward in relation to the plug seat of the metallic shell and is fixedly attachable to the cylinder head through press fitting, for causing the plug seat of the metallic shell to be pressed against the cylinder head, whereby the spark plug is fixedly attachable to the cylinder head.

13. An ignition apparatus for use in an internal combustion engine, comprising a spark plug, which comprises a center electrode disposed at a front end portion of an axial hole formed in an insulator, a metallic shell provided outside the insulator, and a ground electrode joined to the metallic shell and forming a spark discharge gap between the ground and center electrodes, and which spark plug is disposable in a plug disposition hole formed in a cylinder head of the internal combustion engine, the ignition apparatus being adapted to induce spark discharge in the spark discharge gap of the spark plug for igniting an air-fuel mixture, the ignition apparatus being characterized in that:

the metallic shell of the spark plug comprises a flange portion having a plug seat formed on a front end face thereof and adapted to come in contact with the cylinder head directly or indirectly via another member, and a front end portion extending axially frontward from the plug seat of the flange portion, receivable in the plug disposition hole, and having no thread grooves formed on an outer circumferential surface thereof; and in that a plug hole pipe is provided, which is disposable rearward in relation to the plug seat of the metallic shell and is fixedly attachable to the cylinder head, for causing the plug seat of the metallic shell to be pressed against the cylinder head, whereby the spark plug is fixedly attachable to the cylinder head, and wherein the plug hole pipe comprises a flange portion projecting outward from an outer circumferential surface thereof, and the flange portion is fixedly attachable to the cylinder head, whereby the plug hole pipe is fixedly attachable to the cylinder head.

14. An ignition apparatus for use in an internal combustion engine, comprising a spark plug, which comprises a center electrode disposed at a front end portion of an axial hole formed in an insulator, a metallic shell provided outside the insulator, and a ground electrode joined to the metallic shell and forming a spark discharge gap between the ground and center electrodes, and which spark plug is disposable in a plug disposition hole formed in a cylinder head of the internal combustion engine, the ignition apparatus being adapted to induce spark discharge in the spark discharge gap of the spark plug for igniting an air-fuel mixture, the ignition apparatus being characterized in that:

the metallic shell of the spark plug comprises a flange portion having a plug seat formed on a front end face thereof and adapted to come in contact with the cylinder head directly or indirectly via another member, and a front end portion extending axially frontward from the plug seat of the flange portion, receivable in the plug disposition hole, and having no thread grooves formed on an outer circumferential surface thereof; and in that a plug hole pipe is provided, which is disposable rearward in relation to the plug seat of the metallic shell and is fixedly attachable to the cylinder head, for causing the plug seat of the metallic shell to be pressed against the cylinder head, whereby the spark plug is fixedly attachable to the cylinder head, and wherein a cylinder head cover is provided on the cylinder head, and the plug hole pipe and cylinder head cover are adapted such that, in use, the plug hole pipe is held between the cylinder head cover and the cylinder head to thereby be fixedly attached to the cylinder head.

15. An ignition apparatus for use in an internal combustion engine, comprising a spark plug, which comprises a center electrode disposed at a front end portion of an axial hole formed in an insulator, a metallic shell provided outside the insulator, and a ground electrode joined to the metallic shell and forming a spark discharge gap between the ground and center electrodes, and which spark plug is disposable in a plug disposition hole formed in a cylinder head of the internal combustion engine, the ignition apparatus being adapted to induce spark discharge in the spark discharge gap of the spark plug for igniting an air-fuel mixture, the ignition apparatus being characterized in that:

the metallic shell of the spark plug comprises a flange portion having a plug seat formed on a front end face thereof and adapted to come in contact with the cylinder head directly or indirectly via another member, and a front end portion extending axially frontward from the plug seat of the flange portion, receivable in the plug disposition hole, and having no thread grooves formed on an outer circumferential surface thereof; and in that a plug hole pipe is provided, which is disposable rearward in relation to the plug seat of the metallic shell and is fixedly attachable to the cylinder head, for causing the plug seat of the metallic shell to be pressed against the cylinder head, whereby the spark plug is fixedly attachable to the cylinder head, said ignition apparatus further comprising an oil seal member provided between the plug hole pipe and the cylinder head.

* * * * *